US009487897B2

(12) United States Patent
Frost et al.

(10) Patent No.: US 9,487,897 B2
(45) Date of Patent: Nov. 8, 2016

(54) METHOD FOR SELECTIVE DISPLAY OF YARN IN A TUFTED FABRIC WITH OFFSET ROWS OF NEEDLES

(71) Applicant: Tuftco Corporation, Chattanooga, TN (US)

(72) Inventors: Steven L. Frost, Chattanooga, TN (US); Mike Bishop, Chattanooga, TN (US); Brian K. Lovelady, Chattanooa, TN (US); Paul E. Beatty, Chattanooga, TN (US); Michael R. Morgante, Chattanooga, TN (US); Jeffrey D. Smith, Chattanooga, TN (US); Jason Daniel Detty, Chattanooga, TN (US)

(73) Assignee: Tùftco Corporation, Chattanooga, TN (US)

( * ) Notice: Subject to any disclaimer, the term of this patent is extended or adjusted under 35 U.S.C. 154(b) by 0 days.

(21) Appl. No.: 14/854,982

(22) Filed: Sep. 15, 2015

(65) Prior Publication Data

US 2016/0069010 A1 Mar. 10, 2016

Related U.S. Application Data

(63) Continuation-in-part of application No. 14/151,801, filed on Jan. 9, 2014.

(60) Provisional application No. 61/750,755, filed on Jan. 9, 2013.

(51) Int. Cl.

| | |
|---|---|
| ***D05C 15/30*** | (2006.01) |
| ***D05C 15/20*** | (2006.01) |
| ***D05C 15/32*** | (2006.01) |
| ***D05C 15/34*** | (2006.01) |

(52) U.S. Cl.

CPC ..... *D05C 15/20* (2013.01); *D05C 15/30* (2013.01); *D05C 15/32* (2013.01); *D05C 15/34* (2013.01)

(58) Field of Classification Search

CPC ..... D05C 15/20; D05C 15/30; D05C 15/32; D05C 15/34

See application file for complete search history.

(56) References Cited

U.S. PATENT DOCUMENTS

| | | | | | |
|---|---|---|---|---|---|
| 4,549,496 | A * | 10/1985 | Kile | D05C 15/18 | 112/80.08 |
| 4,557,208 | A * | 12/1985 | Ingram | D05C 15/26 | 112/475.23 |
| 5,080,028 | A * | 1/1992 | Ingram | D05C 15/18 | 112/80.08 |
| 5,165,352 | A * | 11/1992 | Ingram | D05C 15/34 | 112/80.08 |
| 5,566,630 | A * | 10/1996 | Burgess | D05C 15/32 | 112/80.41 |
| 5,983,815 | A * | 11/1999 | Card | D05C 15/32 | 112/80.73 |
| 6,550,407 | B1 * | 4/2003 | Frost | D05C 15/32 | 112/220 |
| 7,222,576 | B2 * | 5/2007 | Kilgore | D05C 15/22 | 112/80.5 |
| 7,634,326 | B2 * | 12/2009 | Christman, Jr. | D05C 15/26 | 112/470.01 |
| 7,814,850 | B2 * | 10/2010 | Bearden | D05C 15/34 | 112/220 |
| 8,240,263 | B1 * | 8/2012 | Frost | D05C 15/30 | 112/475.23 |
| 8,359,989 | B2 * | 1/2013 | Hall | D05C 15/34 | 112/470.01 |
| 8,776,703 | B2 * | 7/2014 | Hall | D05C 15/26 | 112/80.23 |
| 9,222,207 | B2 * | 12/2015 | Weiner | D05C 15/30 | |
| 9,290,874 | B2 * | 3/2016 | Mathews | D05C 15/14 | |

* cited by examiner

*Primary Examiner* — Danny Worrell
(74) *Attorney, Agent, or Firm* — Miller & Martin PLLC

(57) ABSTRACT

A novel method of tufting carpets is provided to allow the use of the same sequence of colored yarns on front and rear staggered needle bars to yield sufficient gauge stitch density to provide for a solid appearance of any of the selected colors et, and utilizing optimized tacking of rear yarns to minimize loose yarn on the backing.

21 Claims, 16 Drawing Sheets

METHOD FOR SELECTIVE DISPLAY OF YARN IN A TUFTED FABRIC WITH OFFSET ROWS OF NEEDLES

The present application is a continuation-in-part of U.S. Ser. No. 14/151,801 filed Jan. 9, 2014 and which claims priority to U.S. Provisional Patent Application No. 61/750,755 filed Jan. 9, 2013.

FIELD OF THE INVENTION

The present invention relates to the operation of the tufting machines and is more particularly concerned with method for configuring and operating a tufting machine to economically produce a tufted fabric that displays selected yarns while concealing other yarns to produce novel carpet designs, without leaving long loops of unfastened yarns on the back of the greige.

BACKGROUND OF THE INVENTION

The tufting industry has long sought easy and efficient methods of producing new visual patterns on tufted fabrics. In particular, the industry has sought to tuft multiple colors so that any selected yarns of multiple colors could be made to appear in any desired location on the fabric. Significant progress toward the goal of creating carpets and tufted fabrics selectively displaying one of a plurality of yarns came with the introduction of a servo motor driven yard feed attachments. Notable among these attachments are the servo scroll attachment described in Morgante, U.S. Pat. No. 6,224,203 and related patents; the single end servo scroll of Morgante, U.S. Pat. No. 6,439,141 and related patents; and the double end servo scroll of Frost, U.S. Pat. No. 6,550,407.

In operation the servo scroll yarn feed attachment, when alternating needles are threaded with A and B yarns respectively, allows the control of tufting of heights of yarns so that at a given location on the surface of the tufted fabric, either or both of the A and B yarns may be visible. However, a servo scroll yarn feed carries several yarns on each servo driven yarn feed roll so that the pattern must repeat several times across the width of the fabric and a yarn tube bank must be used to distribute the yarns. The implementation of the single end scroll pattern attachment, and the similar double end servo scroll pattern attachment, permitted the tufting machine to be configured with A and B yarns fed to alternating needles on a front needle bar while C and D yarns were fed to alternating needles on a rear needle bar in order to create color representations on tufted fabrics. The single end scroll yarn feed could create patterns that extended across the entire width of the backing fabric. However, in the full color application described above, these efforts suffered from the difficulty that if a solid area of one color was to be displayed, only one of every four stitches was tufted to substantial height and the remaining three colors were "buried" by tufting the corresponding yarn bights to an extremely low height. With only one of four stitches emerging to substantial height above the backing fabric without compensating by slowing the backing fabric feed, the resulting tufted fabric had inadequate face yarn for general acceptance and in any case excessive yarn was "wasted" on the back of the greige.

The principal alternative to these servo yarn drive configurations has been the use of a pneumatic system to direct one of a plurality of yarns through a hollow needle on each penetration of the backing fabric, as typified by U.S. Pat. No. 4,549,496. Such hollow needle, pneumatic tufting machines were traditionally most suitable for producing cut pile tufted fabrics and have been subject to limitations involving the sizes of fabrics that can be tufted, the production speed for those fabrics, and the maintenance of the tufting machines due to the mechanical complexity attendant to the machines' operation. Accordingly, the tufting industry has had a long felt need for a tufting machine that could operate efficiently to display one of several yarns at a selected location while maintaining a suitable density of face yarns and an output of tufted fabrics at speeds approaching those of conventional tufting machines.

It should be noted that the pneumatic tufting machines utilizing hollow needles as in U.S. Pat. No. 4,549,496 generally tuft laterally for between about one-half to four inches before backing fabric is advanced, or alternatively the backing fabric is advanced at a gradual rate as described in U.S. Pat. No. 5,267,520. Because the yarn being tufted is cut at least every time the color yarn tufted through a particular needle is changed, there is no unnecessary yarn placed as back stitches on the bottom of the tufted fabric. However, when attempts have been made to utilize a regular tufting machine configuration with a needle bar carrying a transverse row of needles in a similar fashion, the yarns are not selected for tufting and cut after tufting, but instead each yarn is tufted in every reciprocal cycle of the needle bar. Therefore yarn carrying needles all penetrate the backing fabric on every cycle. The yarns are selected for display by a yarn pattern device feeding the yarn to be displayed and backrobbing the yarns that are not to be visible thereby burying the resulting yarn bights or tufts very close to the surface of the backing fabric. If several reciprocations are made as the needle bar moves laterally with respect to the backing fabric, then back stitch yarn for each of the colors of yarn is carried for each reciprocation and this results in considerable "waste" of yarn on the bottom of the resulting tufted fabric or greige. Independently Controlled Needle (ICN) tufting machines typified by Kaju, U.S. Pat. No. 5,392,723 and related patents, operate similarly, except the selection of the needles for tufting determines the yarns that will be displayed.

To overcome these difficulties, three methods of configurating and operating tufting machines of conventional design have been devised for the placement of color yarns.

In a first alternative, a pile fabric can be created selectively displaying one of three or more distinct yarns in the following fashion. Using the example of a thread-up featuring four yarns that have distinct colors, an inline needle bar, typically of about $1/10^{th}$ gauge is threaded with a repeat of A, B, C, D over every four needles. The tufting machine is programmed to tuft four stitches laterally before advancing the backing fabric, or while advancing the backing fabric at about one-fourth the customary distance between reciprocations of the needle bar. In this fashion, each of the four adjacent needles threaded with yarns A, B, C, and D respectively will penetrate the backing fabric at nearly the same position. On those four cycles of the needles penetrating the backing fabric, adequate yarn will be fed by the associated servo motor for the color that is desired to predominate visually in that location. Sufficient yarn is fed to allow the yarn bight of the desired color to be tufted at a relatively high level. The other yarns are backrobbed in order to bury their associated yarn bights at a relatively low level. After tufting the four lateral cycles, the backing fabric has advanced by a distance approximately equal to the gauge of the needlebar and the four lateral reciprocation cycle is repeated with the needle bar moving in the opposite direction. It can be seen that this method, although functional, results in excess yarn on the bottom of the tufted fabric compared to ordinary tufted fabrics, and for a four-color thread-up requires that the tufting machine operate only at about one-fourth the speed that it would operate if tufting conventional fabric designs. This technique was described in U.S. Pat. No. 8,141,505 to Hall, and will be discussed in further detail below.

In a second alternative it is possible to create a similar color placement effect in a cut/loop pile fabric utilizing the level cut loop configuration of U.S. Pat. No. 7,222,576 tufted on a tufting machine having about a $1/10^{th}$ gauge needle bar with a four color repeating thread-up. The tufting machine is operated to tuft laterally four times while advancing the backing only about one fourth of the gauge distance on each reciprocation of the needle bar. A yarn color chosen for display may be either a cut or loop bight while the yarn colors not to be shown on the face of the carpet are backrobbed, leaving only very low tufts of those yarns. Obviously, three or more than four different yarns may be used in the thread-up with a corresponding adjustment in the number of lateral shifts and the rate of backing fabric advance. In this method of operation, there is again considerable excess yarn carried on the bottom of the backing fabric.

Both the first and second alternatives are essentially the same techniques that have been utilized with two colors of yarn on a widespread basis in the tufting industry in past years. Although multiple cycles of lateral shifting presents some issues not present when shifting only a single lateral step, the principal issue is one of avoiding over-tufting or sewing exactly in the same puncture of the backing fabric made by a previous cycle of a nearby needle. This is typically addressed by using one or both of positive stitch placement and continuous, but reduced speed, backing fabric feed.

An additional problem presented by the first and second alternative techniques is the sheer number of penetrations of the backing fabric which results in degradation or slicing of nonwoven backing fabric materials that may be utilized in the manufacture of tufted fabrics for carpet tiles and special applications such as automotive carpets.

Finally, to overcome these shortcomings, a third alternative to produce similar fabrics with yarn placement has been achieved with a staggered needle configuration having front and rear rows of needles offset or staggered from one another. A staggered needle bar typically consists of two rows of needles extending transversely across the tufting machine. The rows of needles are generally spaced with a 0.25 inch offset in the longitudinal direction and are staggered so that the needles in the rear transverse row are longitudinally spaced between the needles in the front transverse row. Alternatively, two sliding needle bars each carrying a single transverse row of needles may be configured in a staggered alignment. Particularly when two sliding needle bars are used, the longitudinal offset between the rows of needles may be greater than 0.25 inches, and often about 0.50 inches.

In operation the needle bar is reciprocated so that the needles penetrate and insert loops of yarn in a backing material fed longitudinally beneath the needles. The loops of yarn are seized by loopers or hooks moving in timed relationship with the needles beneath the fabric. In most tufting machines with two rows of needles, there are front loopers which cooperate with the front needles and rear loopers which cooperate with the rear needles. In a loop pile machine, it may be possible to have two separate rows of loopers such as those illustrated in U.S. Pat. No. 4,841,886 where loopers in the front hook bar cooperate with the front needles and loopers in the rear hook bar cooperate with rear needles. Similar looper constructions have been used in tufting machines with separate independently shiftable front and rear needle bars, so that there are specifically designated front loopers to cooperate with front needles and specifically designated rear loopers to cooperate with rear needles. To achieve maximum density of needle penetrations, and to minimize the possibility of tufting front and rear needles through the same penetrations of the backing fabric, it is desirable to stagger the front loopers from the rear loopers by a half gauge unit.

The result of having loopers co-operable with only a given row of needles on a gauge tufting machine with two independently shiftable needle bars is that it is only possible to move a particular needle laterally by a multiple of the gauge of the needles on the relevant needle bar. Thus for a fairly common 0.20 inch ($1/5^{th}$) gauge row of needles with corresponding loopers set at 0.20 inch gauge, the needles must be shifted in increments of 0.20 inches. This is so even though in a staggered needle bar with two longitudinally offset rows of 0.20 inch gauge needles the composite gauge of the staggered needle bar is 0.10 inch gauge. The necessity of shifting the rows of needles twice the gauge of the composite needle assembly results in patterns with less definition than could be obtained if it were possible to shift in increments of the composite gauge.

One effort to reduce the gauge of tufting has been to use smaller and more precise parts. Furthermore, in order to overcome the problem of double gauge shifting, U.S. Pat. No. 5,224,434 teaches a tufting machine with front loopers spaced equal to the composite gauge and rear loopers spaced equal to the composite gauge. Thus on a tufting machine with two rows of 0.20 inch gauge needles there would be a row of front loopers spaced at 0.10 inch gauge and a row of rear loopers spaced at 0.10 inch gauge. Although this allows the shifting of each row of needles in increments equal to the composite gauge, this solution was limited in by difficulties in creating cut and loop pile tufts from both the front needles and the rear needles.

Taking the arrangement of staggered needle bars shiftable at a composite gauge, and threading front needles with A and B yarns and rear needles with C and D yarns to form a repeat, a high volume of tufted fabric with selectively placed colored yarns can be manufactured with minimal wasted yarn used in the back stitching. This is because it is only necessary to shift each row of needles by a single lateral step in order to place all four A, B, C and D yarns in the desired location as described in U.S. Pat. No. 8,240,263. A principal disadvantage to this tufting arrangement and operation is the requirement for the use of twice as many needles and twice as many single end yarn drives as would be the case with slower and less efficient tufting arrangements for the selective placement of individual yarns. This results in increased cost and complexity of the tufting machine. Accordingly, improved methods of tufting machine operation to accomplish yarn color placement are still needed.

SUMMARY OF THE INVENTION

The present invention is addressed to techniques allowing a tufting machine to be threaded with at least two colors of yarn, and to display selected colors at any location on the face of the carpet, while burying other yarn colors, maintaining adequate face yarn density, and minimizing the tacking stitches necessary to hold loose yarns on the back of the backing fabric. Furthermore, such fabrics can be tufted on a tufting machine of conventional design and configuration so that the cost of the tufting machine is not prohibitive and the machine can also be used in the manufacture of many pre-existing fabric patterns.

BRIEF DESCRIPTION OF THE DRAWINGS

Particular features and advantages of the present invention will become apparent from the following description when considered in conjunction with the accompanying drawings in which.

DETAILED DESCRIPTION OF THE INVENTION

Figure 1:
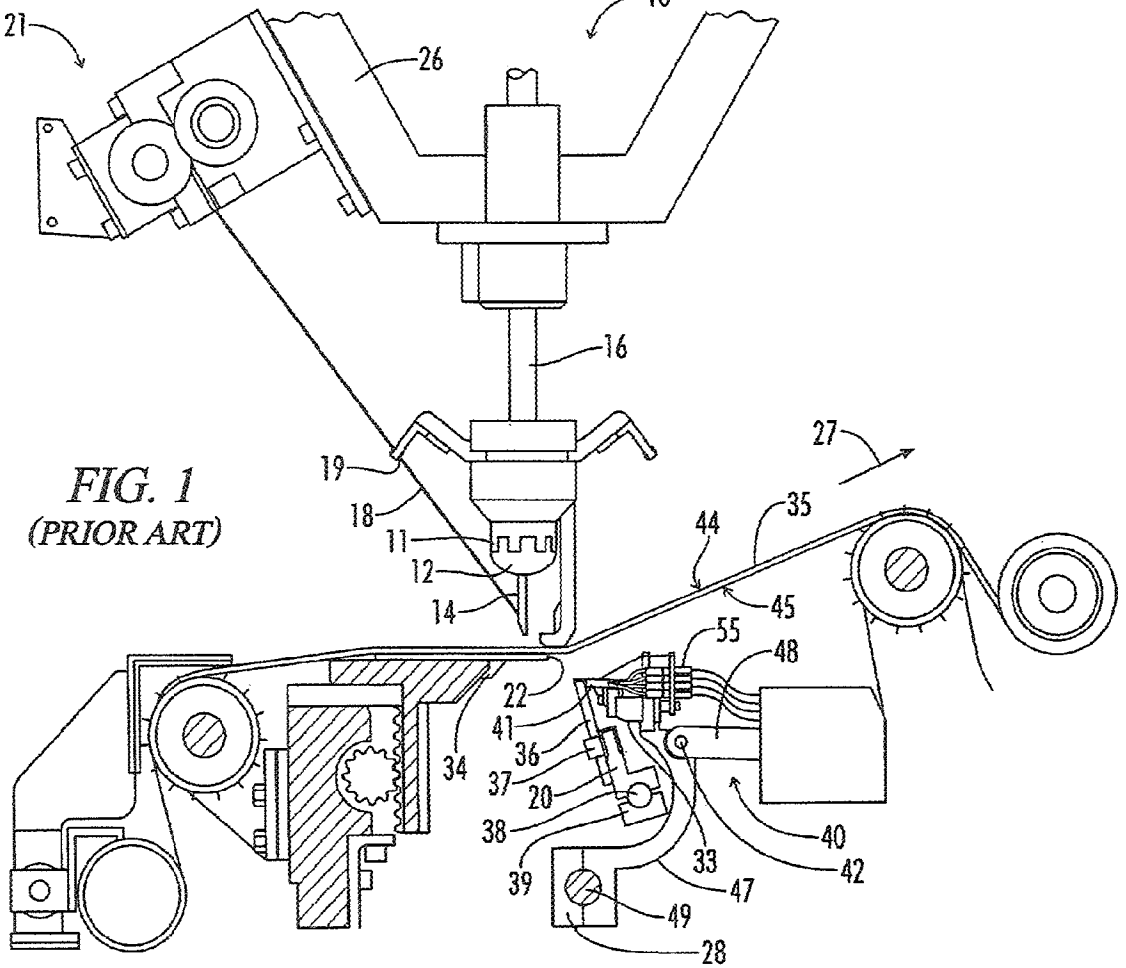
FIG. 1 (PRIOR ART)
FIG. 1 is a partial sectional end view of a prior art tufting machine with a single row of needles that can be operated to place colored yarns in the manufacture of fabrics with cut and loop face yarns.

Referring now to the drawings in more detail, FIG. 1 discloses a multiple needle tufting machine 10 including an elongated transverse needle bar carrier 11 supporting a needle bar 12. The needle bar 12 supports a row of transversely spaced needles 14. The needle bar carrier 11 is connected to a plurality of push rods 16 adapted to be vertically reciprocated by conventional needle drive mechanism, not shown, within the upper housing 26.

Yarns 18 are supplied to the corresponding needles 14 through corresponding apertures in the yarn guide plate 19 from a yarn supply, not shown, such as yarn feed rolls, beams, creels, or other known yarn supply means, preferably passing through pattern yarn feed control 21. The yarn feed control 21 interfaces with a controller to feed yarns in accordance with pattern information and in synchronization with the needle drive, shifters, yarn seizing/cutting mechanisms and backing fabric feed.

The needle bar 12 may be fixedly mounted to the needle bar carrier 11 or may slide within the needle bar carrier 11 for transverse or lateral shifting movement by appropriate pattern control needle shifter mechanisms, in well-known manners. The backing fabric 35 is supported upon the needle plate 34 having rearward projecting transversely spaced front needle plate fingers 26, the fabric 35 being adopted for longitudinal movement from front-to-rear in a feeding direction, indicated by the arrow 27, through the tufting machine 10.

The needle drive mechanism, not shown, is designed to actuate the push rods 16 to vertically reciprocate the needle bar 12 to cause the needles 14 to simultaneously penetrate the backing fabric 35 far enough to carry the respective yarns 18 through the backing fabric 35 to form loops on the face thereof. After the loops are formed, the needles 14 are vertically withdrawn to their elevated, retracted positions. A yarn seizing apparatus 40 in accordance with this illustration includes a plurality of gated hooks 41, there preferably being at least one gated hook 41 for each needle 14.

Each gated hook 41 is provided with a shank received in a corresponding slot in a hook bar 33 in a conventional manner. The gated hooks 41 may have the same transverse spacing or gauge as the needles 14 and are arranged so that the bill of a hook 42 is adapted to cross and engage with each corresponding needle 14 when the needle 14 is in its lower most position. Gated hooks 41 operate to seize the yarn 18 and form a loop therein when the sliding gate is closed by an associated pneumatic cylinder 55, and to shed the loop as the gated hooks 41 are rocked.

The elongated, transverse hook bar 33 and associated pneumatic assembly are mounted on the upper end portion of a C-shaped rocker arm 47. The lower end of the rocker arm 47 is fixed by a clamp bracket 28 to a transverse shaft 49. The upper portion of the rocker arm 47 is connected by a pivot pin 42 to a link bar 48, the opposite end of which is connected to be driven or reciprocally rotated by conventional looper drive. Adapted to cooperate with each hook 41 is a knife 36 supported in a knife holder 37 fixed to knife block 20. The knife blocks 20 are fixed by brackets 39 to the knife shaft 38 adapted to be reciprocally rotated in timed relationship with the driven rocker arm 47 in a conventional manner. Each knife 36 is adapted to cut loops formed by each needle 14 upon the bill of the hook 41 from the yarn 18 when gates are retracted and yarn loops are received on the hooks 41. A preferred gated hook assembly is disclosed in U.S. Pat. No. 7,222,576 which is incorporated herein by reference. When a tufting machine of this type is threaded with A, B, C, and D yarns repeating every four needles, it is suitable to manufacture tufted fabric according to the second alternative described above in the Background of the Invention.

In order to reduce the likelihood of needles from one cycle of tufting entering the exact same openings that were tufted on a previous cycle, a technique referred to in the tufting industry as "positive stitch placement" may be utilized. In this procedure, the needles are shifted slightly out of line with their associated loopers and the needles begin their downward path until engaging in the backing fabric. Once engaged in the backing fabric, the needles are moved by a shifting apparatus into their proper alignment with associated loopers and the needles continue their downward path carrying yarns through the backing fabric and the yarns are seized by the loopers. Mechanical or servo motor driven cam shifters, servo motor controlled roller screw shifters, and hydraulic shifters may be used for this purpose, although the servo motor driven shifters provide the most easily controlled interface with the tufting machine.

An additional technique that may minimize the lateral yarns on the backstitch side of the tufted fabric involves no-sewing or unsewing yarns that are not intended to be displayed. Such yarns are necessarily tufted with relatively little yarn being fed, so that the yarn loops are backrobbed resulting in low tufts that are concealed by relatively higher tufts of the yarns that are intended to be displayed. If the yarn for these low tufts is backrobbed to the extent that there is no tuft bind and the backstitch yarn lays flat across the backing fabric, the yarn used between visible yarn bights is reduced. So long as the yarn is periodically left penetrating the backing fabric, about every longitudinal inch or more preferably half-inch, generally corresponding to every ten to fourteen needle bar reciprocations, or when tight backstitching is desired about every fourth or fifth reciprocation (and even as frequently as every alternate reciprocation), the yarn used to carry "buried" yarns from one display location to another may be reduced. Depending upon the pattern, placing tacking stitches about every half inch or twelfth stitch can save between about 2% and 10% of the yarns needed to manufacture the fabric.

However, if yarns are not controlled so that they can be tacked periodically by tufting a buried or visible yarn bight, then loose segments of backstitch yarn on the backing present two problems for further processing of the greige. First, the loose yarn segments form loops hanging from the backing that can be snagged on equipment as the greige is being processed and this can both foul equipment and pull tufts from the face of the tufted greige, ruining its appearance. Second, the bunching of loose yarns on the backing can interfere with the finishing process as it may require substantially larger amounts of latex coating and result in irregular attachment of the secondary backing. Larger amounts of latex are not only more costly, but also add weight and rigidity to the carpet and require additional time and heat to cure after application. Thick latex backings also complicate the installation of the carpet since it is more difficult for the installers to cut and position.

Figure 2A:
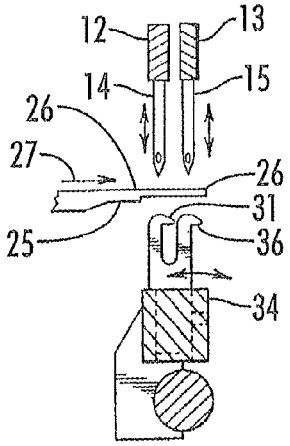
FIG. 2A (PRIOR ART)
FIG. 2A is a side elevation view of a second prior art needle and looper assembly for making loop pile carpet with two transverse rows of longitudinally offset needles.

In FIG. 2A, a prior art loop pile tufting machine is shown with front needle bar 12 supporting front needles 14 and rear needle bar 13 supporting rear needles 15 in an upper position. Backing fabric, not shown, is fed over a needle plate 25 in direction 27 and is supported by needle plate fingers 26 in the area where needles 14 and 15 penetrate the backing fabric. When needles 14 and 15 are driven downward into a lower position by conventional means to penetrate the backing fabric, the front loopers 31 and rear loopers 36 mounted in looper bar 34 are reciprocated to cross front needles 14 and rear needles 15 respectively.

Figure 2B:
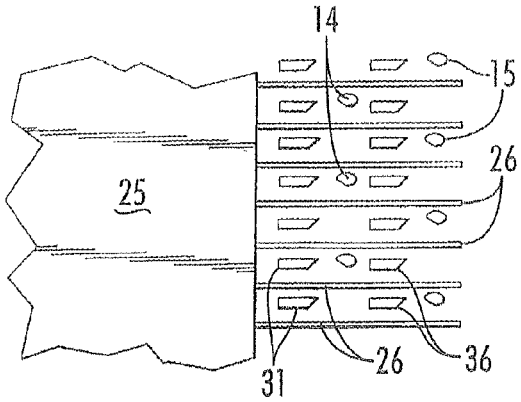
FIG. 2B (PRIOR ART)
FIG. 2B is a top sectional view of the prior art needle and looper assembly of FIG. 2A, showing the staggered needles and the hooks positioned at the composite needle gauge.

The looper bar 34 is reciprocated by conventional means, not shown, acting on a rocker shaft, so that loopers 31 and 36 seize and release loops of yarn thereby forming loop pile tufts on the bottom surface of the backing fabric. FIG. 2B shows the arrangements of needles 14 and 15, and loopers 31 and 36 from a top view. It will be seen that the front and rear loopers 31 and 36 are in line, but the needles may shift in single gauge units. By way of example, the illustrated front needles 14 may be spaced at $1/5^{th}$ gauge and the loopers 31 are therefore spaced at $1/10^{th}$ gauge. In this example, the front needles 14 may be shifted in $1/10^{th}$ gauge increments. A disadvantage to this particular arrangement is that the front and rear gauge positions are directly in line. This may cause over sewing where front and rear yarns are tufted in the same openings in the backing material, resulting in an irregular appearance of yarns on the face. A configuration of where the loopers 31, 36 are slightly staggered transversely can address this concern. Variations of the $1/5^{th}$ gauge needle spacing and $1/10^{th}$ gauge looper spacing are also possible such as $1/6^{th}$ gauge needle spacing and $1/12^{th}$ gauge looper spacing or even $1/4^{th}$ gauge needle spacing and $1/8^{th}$ gauge looper spacing for bulkier yarns. However, 1/12th gauge looper spacing becomes less practical to operate efficiently and narrower gauges such as 5/64th looper spacing that would be utilized with 5/32nd needle spacing are even less practical.

Figure 3:
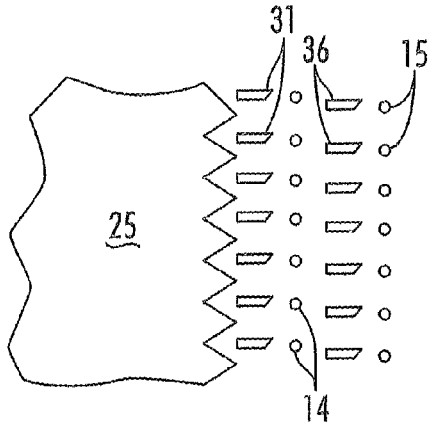
FIG. 3 is a top sectional view of two transverse rows of longitudinally offset needles with the needles and associated loopers of each row partially staggered from one another.

A needle bar and looper configuration that is of particular interest in creating fine gauge fabrics is shown in FIG. 3. In this configuration, the front and rear loopers are slightly staggered and may be set at relatively fine gauge spacing such as 1/8th or 1/10th gauge.

Figure 4:
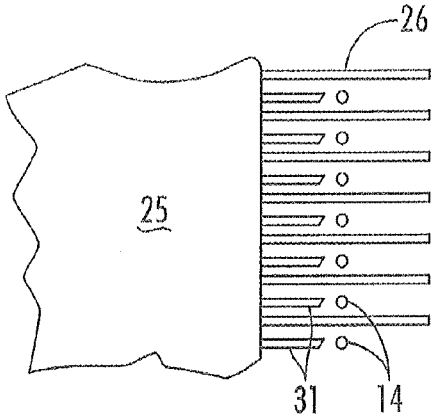
FIG. 4 is a top sectional view of a single row of needles and loopers.

FIG. 4 is a top view of a needle bar with a single row of needles 14 associated with loopers 31 and where a backing fabric, not shown, would pass over needle plate 25 and needle plate fingers 26 for tufting. To create a carpet with more than two colors of yarn and a sufficient tuft density when all but one of the colors is buried, a single row of needles 14 as illustrated in FIG. 4, must generally be tufted laterally in multiple steps, such as in four steps for a four color pattern as depicted in the backstitch illustration of FIG.

Figure 5A:
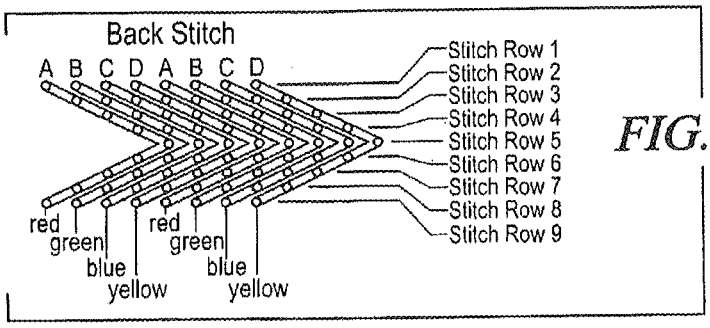
FIG. 5A is a schematic illustration of the back stitching on a backing fabric tufted by moving a needle bar with an A, B, C, D thread-up laterally for four reciprocations of the needle bar and then tufting in the opposite lateral direction for four reciprocations of the needle bar.
Figure 5B:
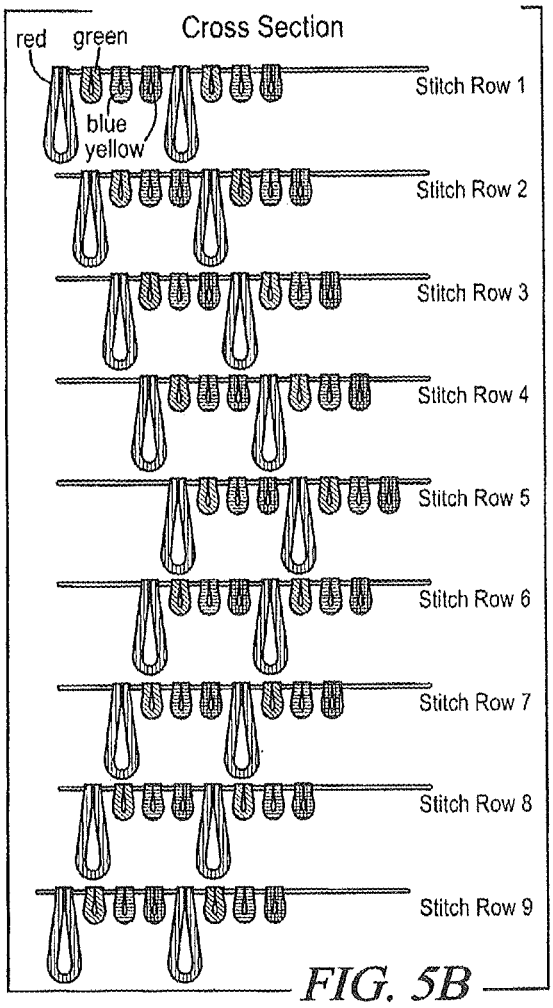
FIG. 5B is a sectional view of the fabric of FIG. 5A, with red yarns tufted high and green, blue, and yellow yarns tufted low.
Figure 5C:
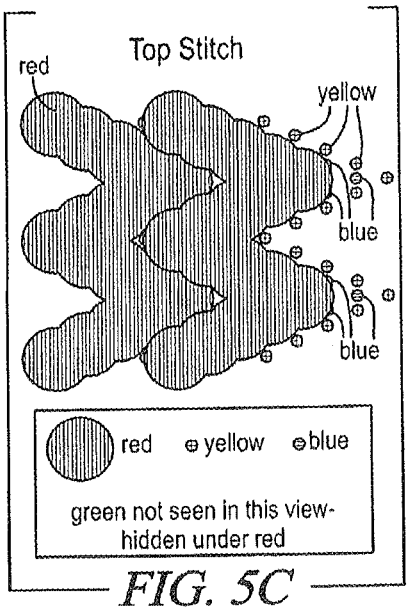
FIG. 5C is a schematic illustration of the face of the fabric of FIG. 5A.

5A. Thus, if carpet were being tufted with eight longitudinal rows of stitches per inch, as when using a $118^{th}$ gauge needle bar, this method of tufting requires that the single needle bar threaded with A, B, C, and D yarns be tufted through four needle bar reciprocations as the backing fabric advances about $118^{th}$ of an inch to achieve the same density of face yarns as if the needle bar were tufting unshifted with no buried stitches. Although the backing fabric could be halted for the four reciprocations and then indexed to advance an eighth of an inch, it is generally preferred to keep the backing advancing but at a reduced speed. This helps minimize the possibility of over-sewing. Next the shifting of the needle bar is reversed for the following four reciprocations of the needle bar while the backing fabric is again advanced another $118^{th}$ of an inch. This technique produces sufficient tuft density to provide good coverage of the face of the fabric by a single yarn color (designated red in the drawings) as illustrated in top view of the face of the resulting fabric in FIG. 5C. FIG. 5B shows a lateral cross section of each transverse row of yarn bights. The illustrated nine transverse rows of yarn bights have to be longitudinally compressed to fit in a space where ordinarily less than three rows of tufts would otherwise be placed. Because many of the loops of yarn are pulled low, the actual density of visible tufts on the face of the greige is not excessive.

This single row of needles yarn thread up also benefits from the use of positive stitch placement and the backrobbing of yarns sufficient to completely remove or unsew some yarn loops from the backing material on at least selected reciprocations of the colors of yarn that are not intended to be displayed on the face of the carpet as described above. However, use of this technique to produce four color tufted fabrics with solid areas of color suffers drawbacks. For instance, tufting of fabric is slow due to the necessity to shift the needle bar laterally and reciprocate four times before advancing the length that the backing would ordinarily be advanced with each reciprocation of the needle bar if all the yarns were being tufted to full height. In addition, the close penetrations of the needles may slice some nonwoven backing fabrics that are desirable for use in carpet tile and other special applications. Finally, the backstitching consumes a substantial quantity of yarn as the three yarns that are buried on each cycle of the needlebar are carried back and forth laterally.

Accordingly, arrangement of front loopers 31 and front needles 14 staggered by a half gauge from rear loopers 36 and rear needles 15, as described in U.S. Pat. No. 8,240,263. is most desirable, as it is possible to tuft a four color yarn threadup at much greater speeds than using a single needle bar and much less yarn is wasted on the bottom of the backing fabric with lateral backstitching.

However, this speed and efficiency requires a very costly tufting machine with pattern control yarn feeds and associated yarn creels on each side of the tufting machine to feed front and rear needles. The number of needles required, and assorted yarn feed rolls, is twice that required for traditional tufting set ups. Therefore, a $1/10^{th}$ gauge fabric will have 20 needles per inch (ten on each of the front and rear rows of needles). In addition, the density of gauge parts in $1/10^{th}$ gauge configuration of two needle bars is so tight that the needle bars are typically spaced one-half inch apart, which is not preferred since the greater distance requires greater precision to insure alignment of stitches from each needle bar.

Figure 6A:
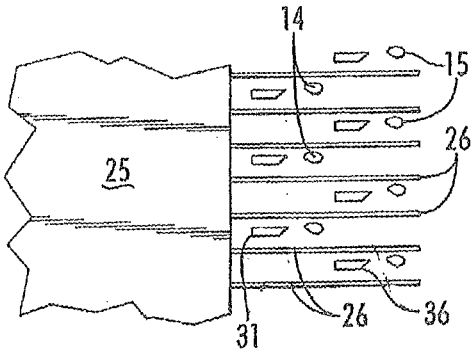
FIG. 6A is a top sectional view of a needle and looper arrangement with two offset rows of staggered needles having associated loopers spaced at half the gauge of the needles.

Turning then to FIG. 6A, a $1/5^{th}$ gauge fine line needle and looper arrangement is shown with front needles 14 and rear needles 15 each longitudinally spaced at $1/5^{th}$ inch increments. Front loopers 31 and rear loopers 36 are spaced at $1/5^{th}$ gauge increments so that the needles 14 in front row or needles 15 in rear row can be shifted laterally in $1/5^{th}$ gauge steps. The needles and their associated loopers are staggered between front and rear so that a $1/10^{th}$ gauge fabric can be tufted at the composite gauge. The front needles 14 and rear needles 15 are spaced transversely at the same gauge, typically about 1/6th inch, although 5/32nds gauge, 1/5th gauge, and even 1/7th gauge can be used to similar effect. The rows of needles 14,15 and their associated loopers 31,36 are staggered. It is to be understood that the loopers 31,36 are only representative, and any variety of gauge parts may be suitably used, including hooks, knives, and in some cases cut/loop apparatus.

The 1/6th gauge spacing is of particular interest as the staggered placement of two $1/6^{th}$ gauge rows of needles provides the equivalent of 1/12th gauge in-line tuft placement. In practice, it is difficult to operate a tufting machine with a 1/12th gauge in-line shifting needle bar at full speed without difficulties due to the very tight spaces in which the adjacent needles and gauge parts must be reciprocated. The closeness of the rapidly moving parts leads to excess friction, abrasion, and even clashing of needles and gauge parts. However, the use of two staggered rows of $1/6^{th}$ gauge needles allows $1/12^{th}$ gauge tuft precision to be achieved in the resulting fabric with adequate space for reciprocation of the needles and gauge parts. Exemplary operations of this configuration of needles and gauge parts are discussed in connection with FIG. 10 below.

Figure 6B:
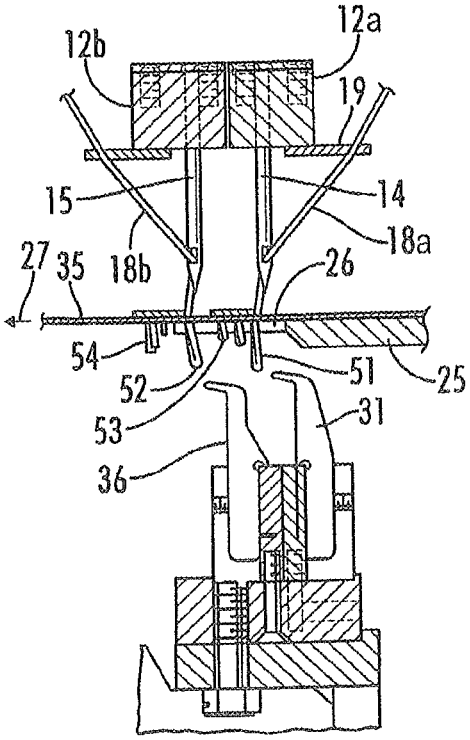
FIG. 6B is a reverse angle side elevational view of the needle and looper assembly of FIG. 6A that is threaded and tufting yarn bights.

Typically, with independently shiftable needle bars as reflected in FIG. 6B, the front row of needles 14 is one quarter inch forward of the rear row of needles 15. For this reason, in order to synchronize the tufting of a pattern, the front needles in a $1/5^{th}$ gauge-four color setup will sew the first reciprocation cycle of a pattern while the rear needles 15 sew a ten cycle offset of that pattern. Such a setup will tuft forty reciprocal penetrations of the backing fabric per inch for each needle bar. The calculation of the stitch offset compensation is computed by determining the number of stitches required to make up the offset distance. So for a one-half inch offset and a stitch rate of 40, the offset is twenty reciprocations and the front needles sew the first reciprocation cycle from the pattern while the rear needles sew a twenty cycle offset. In a setup with $1/6^{th}$ gauge needle spacing, quarter inch offset, and six colors tufting at 36 stitches per inch, the stitch offset compensation would be nine reciprocations and the front needles 14 sew cycle one while the rear needles 15 sew a nine stroke offset of the pattern. In this fashion, after nine stitches, the tufts created by front and rear needles align in accordance with the pattern.

Frequently, it is desirable to tuft at a lower stitching rate so that a 1/5th gauge, four color setup can be effectively tufted at 25 to 32 needlebar strokes per inch rather than 40. At these lower gauges, the offset is typically one-quarter inch since the gauge parts are not so crowded. In the event that the preferred rate is determined to be 30 strokes per inch, then the offset stitch compensation can be reduced to about seven. Even when the needlebar stroke rate is a number that does not lead to an exact stitch offset compensation, such as 27.5 stitches per inch, using the closest suitable approximations of six results in sufficiently close placement of the stitches from the rear needle bar, never more than a distance of about half the gauge spacing out of alignment. An offset stitch computation table is provided in the paragraphs below.

Optimal stitch rates in fabrics where solid color areas in patterns dictate backrobbing half or even more of the loops formed to a low hidden level or even removal from the backing material can be computed based upon the number of colors of yarn threaded on the needles and the composite gauge of the staggered needle bars. So, for staggered ⅕th gauge needle bars having a composite $1/10^{th}$ gauge, multiply the reciprocal of the gauge (10) by the number of colors (use 3 for example in an A,B,C/A,B,C thread-up) to obtain the quantity 30. The preferred longitudinal stitch rate will then likely fall in the range between 50% and 100% of the determined quantity, or in this instance between 15 and 30 stitches per inch. Even more optimally, the stitch rate will be between 60% and 80% of the determined quantity. This means that the backing fabric is advanced by a distance equal to between one and two times the reciprocal of the determined quantity ($1/30^{th}$ to $1/15^{th}$ of an inch), or optimally between 1.25 and 1.67 times the determined quantity.

FIG. 6B shows current yarn loops 51, 52 being formed by needles 14, 15 as they penetrate the backing fabric 35 where the loops can be seized by loopers 31, 36. After the loops are formed, they can be backrobbed to a lower height as loops 53, 54 or even backrobbed sufficiently to completely remove or unsew the loop from penetrating the backing fabric. The most precise yarn feed can even leave the backrobbed loops to remain within the thickness of the backing fabric so that the loops either do not ever fully penetrate the fabric or penetrate the fabric insubstantially. Such precision provides tacking stitches with minimal use of yarns.

Figure 7A:
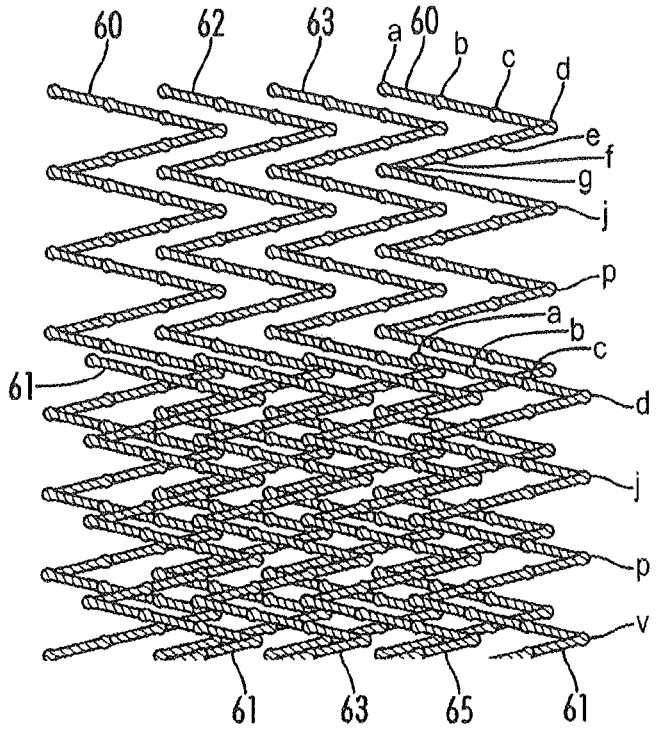
FIG. 7A illustrates backstitching made by two offset shiftable needle bars as in FIG. 6 that are operated without offset stitch compensation.
Figure 7B:
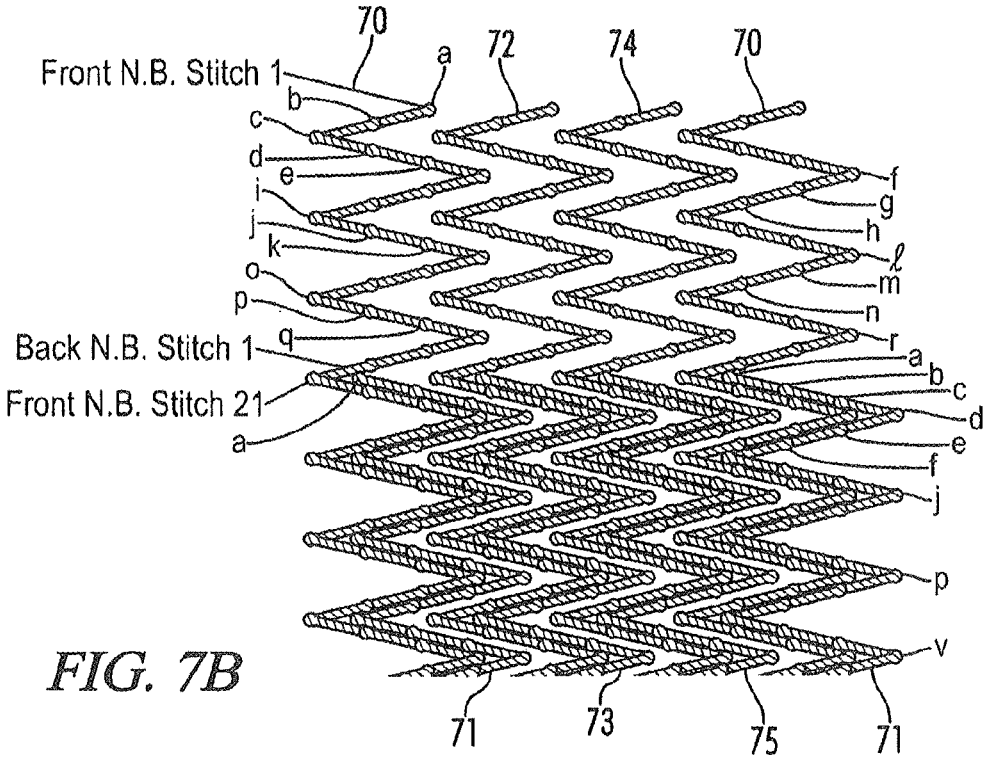
FIG. 7B illustrates backstitching made by two offset shiftable needle bars as in FIG. 6 that are operated with offset stitch compensation.

FIG. 7A demonstrates the effect of failing to use proper stitch offset compensation where front yarns 60, 62 and 64 and rear yarns 61, 63 and 65 both are sewing the first cycle of the pattern at the outset. Due to half inch offset spacing between needle bars and a stich rate of forty needle bar cycles per inch, the appropriate offset is twenty cycles. Thus, first front needle penetration 60*a* is very nearly longitudinally aligned with first rear penetration 61*a*, however, as the pattern progresses and the penetrations tufted with front yarns 60, 62 and 64 are overtufted by rear yarns 61, 63 and 65 it can be seen that there is not a uniform density of possible tuft locations and there may be resulting gaps in coverage of the backing fabric. On the other hand, with a twenty reciprocation offset compensation as shown in FIG. 7B, after twenty cycles the rear yarns 71, 73 and 75 align perfectly with the front yarns 70, 72 and 74, and if not for the additional spacing between pairs of yarns for clarity it could be seen that there would be comprehensive coverage of the backing fabric by the backstitching. FIGS. 7A and 7B depict the arrangement of three yarns on each of the front and rear rows of needles so that sequential stitching in each direction is only three reciprocal penetrations of the backing.

Of course, the back stitch created in FIG. 7B has the same appearance as the back stitch created with a single row of needles having only half the gauge spacing. Thus, the two $1/5^{th}$ gauge rows of needles produce a backing having the same appearance as a single row of $1/10^{th}$ gauge spaced needles. If each stitch of yarn penetrates the backing fabric and is not backrobbed, the resulting carpet is effectively identical.

However, as previously mentioned, it is desirable not to leave buried yarn bights in the backing on every stitch in order to minimize the use of yarn. Yet, it is also desirable to have occasional buried bights to prevent loose backstitch yarns from forming on the back of the greige that could become entangled or complicate the application of latex or other backing material.

A surprising advantage of the dual front and rear needle bar solution illustrated in FIG. 6 is that the backstitch yarns from the rear needle bar will overtuft the backstitch yarns from the front needle bar. This obviates the need for any tacking bights to be made with the front yarns as the rear yarns overtufting the front yarns on the backing eliminates the problem of loose front yarns. Often only occasional tacking stitches will need to be made with the rear yarns.

This advantage is illustrated in FIGS. 8A through 8G. In these figures, four colors of front yarns 81,82,83,84 are threaded on the front needles 14 and four colors 91,92,93,94 are threaded on the rear needles 15. As with FIG. 7, the penetrations for each yarn are designated by sequentially increasing letters a, b, c, etc. Thus, the first penetration shows a first rear yarn 91 being tufted at point 91*a* and a first front yarn 81 being tufted at point 81*a*. As the first four reciprocations are made in the pattern, it can be seen that rear yarns 91 and 93 are forming tufts so that the penetrations at positions 91*b*,91*c*,91*d* and 91*e* are all fixed by loops penetrating the backing fabric, as are the stitches at positions 93*b*,93*c*,93*d* and 93*e*. On the other hand, the front yarns 81-84 and two rear yarns 92 and 94 are not forming tufts in the backing and so are not fixed to the backing at any point other than the first stitch locations a.

Figure 8A:
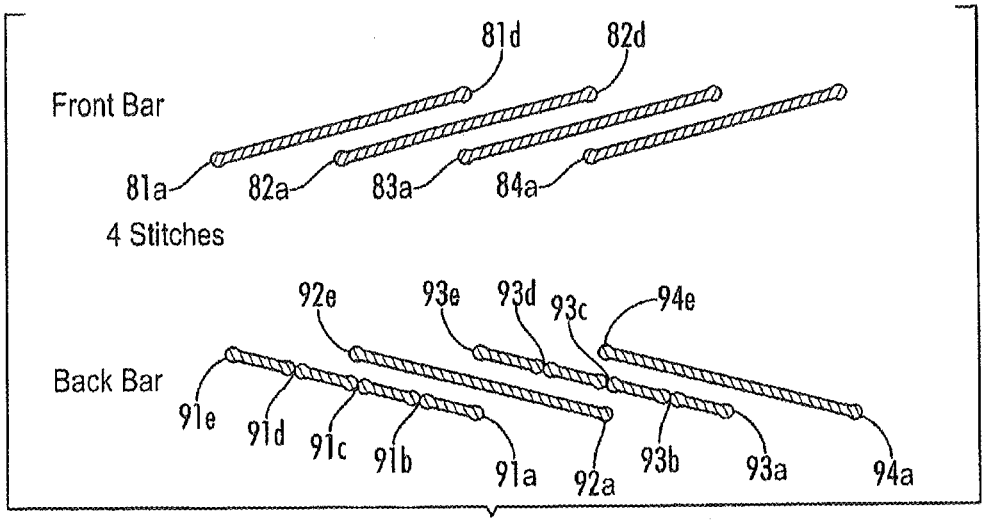
FIG. 8A represents the backstitching from tufting of the initial penetration and four laterally shifted reciprocations by front and back needle bars with pattern offset stitch compensation.
Figure 8B:
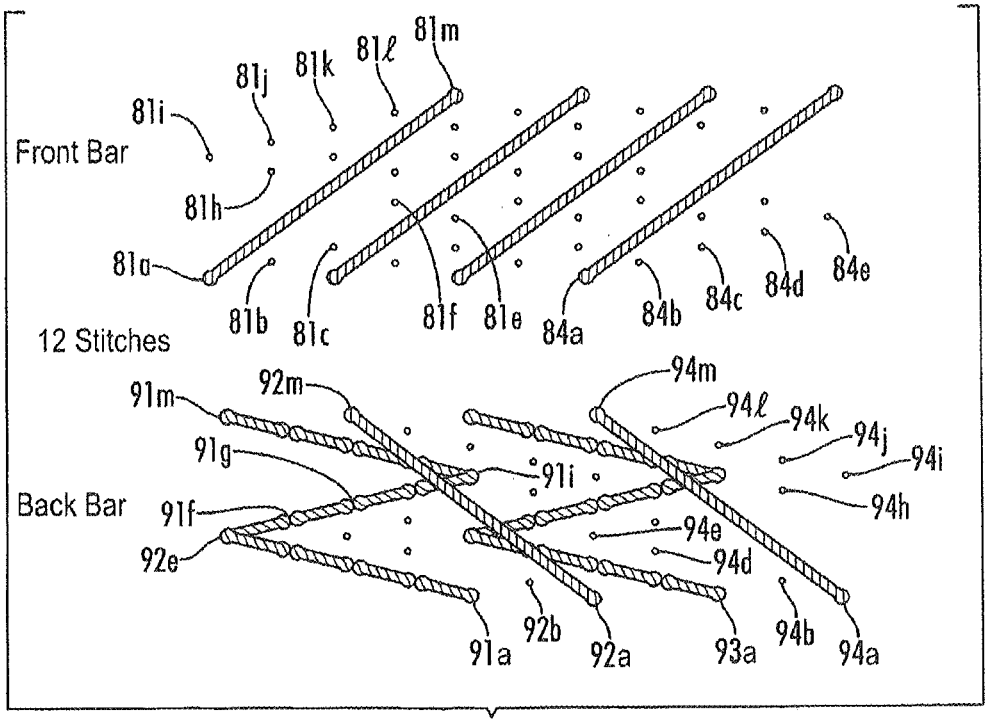
FIG. 8B depicts the backstitching of FIG. 8A extended to twelve reciprocations.
Figure 8C:
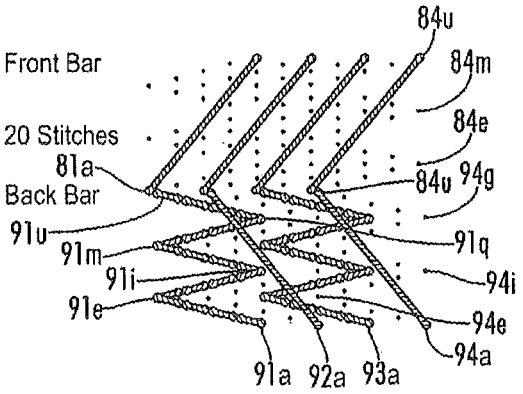
FIG. 8C depicts the backstitching of FIG. 8A extended to twenty reciprocations.

FIG. 8B shows the pattern as it has progressed through twelve reciprocations so that now the yarns that are being tufted to penetrate and form tufts on the face of the fabric, 91 and 93, have created Z-shaped backstitch patterns while the remaining yarns that are being backrobbed so as not to form tufts in the backing fabric continue to be unfixed to the backing material other than the first stitch locations a. FIG. 8C shows the pattern after twenty reciprocations have been completed so that the first penetrations a of front yarns 81-84 are aligned with the twenty-first penetrations u of the rear yarns 91-94. Again, only yarns 91 and 93 are creating tufts on the face of the fabric so that the remaining yarns 81-84,92,94 are not fixed other than the first penetration locations a.

Figure 8D:
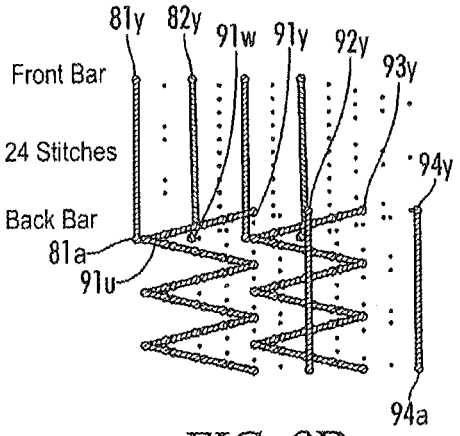
FIG. 8D depicts the backstitching of FIG. 8A extended to twenty-four reciprocations.
Figure 8E:
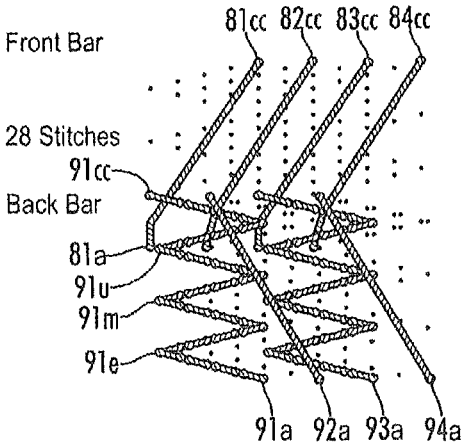
FIG. 8E depicts the backstitching of FIG. 8A extended to twenty-eight reciprocations.
Figure 8F:
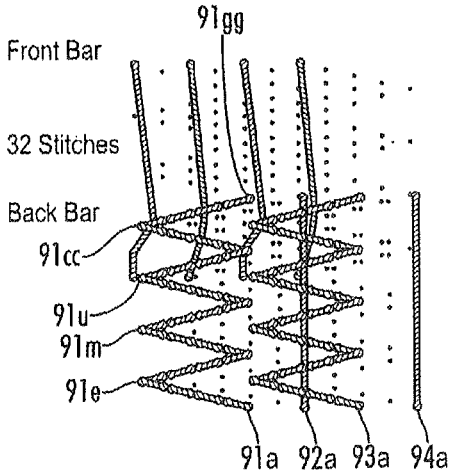
FIG. 8F depicts the backstitching of FIG. 8A extended to thirty-two reciprocations.

As the pattern proceeds from reciprocation 20 to reciprocation 24 in FIG. 8D, it can be seen that rear yarns 91 and 93 begin to overtuft front yarns 82,84. This overtufting results in tacking front yarns 82,84 into place so that they are no longer loose and unsupported from their original tuft locations a. As the pattern proceeds in FIGS. 8E and 8F to the twenty-eighth and thirty-second reciprocations, it can be seen that all of the front yarns 81-84 are overtufted by rear yarns 91,93 and now only the rear yarns 92,94 that have not been forming tufts on the face of the carpet are unattached.

Figure 8G:
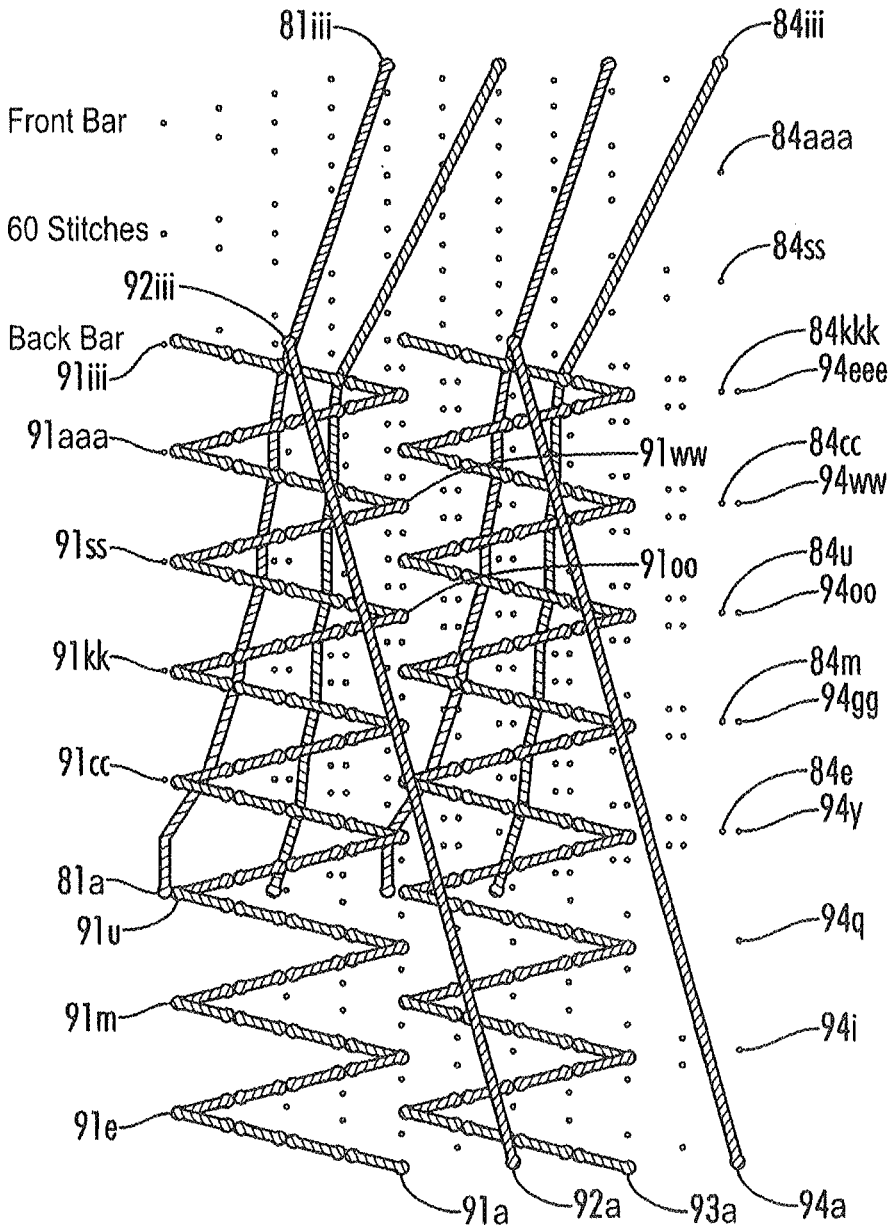
FIG. 8G depicts the backstitching of FIG. 8A extended to sixty reciprocations.

In FIG. 8G, the pattern has proceeded for sixty reciprocations and a number of the perforations created by yarns that were backrobbed from the backing fabric have been identified for ease of reference where it can be seen that the right most penetrations created by the right most rear yarn are designated 94*a*, 94*i*, 94*q*, 94*y*, 94*gg*, 94*oo*, 94*ww*, and 94*eee*. Similarly, it can be seen that the left most penetrations of the left most rear yarn are designated 91*e*, 91*m*, 91*u*, 91cc, 91*kk*, 91*ss*, 91*aaa*, and 91*iii*. The tufting of yarns 91 and 93 have overtufted the front yarns 81-84 and those backstitch yarns present no dangling looping hazards or backing difficulties. On the other hand, rear yarns 92, 94 that have not been tufted are free for a length of sixty stitches and this would create a generally unacceptable amount of free yarn on the backing. To avoid this eventuality, such rear backstitch yarns would generally be tufted every two to fourteen reciprocations, or perhaps every longitudinal half-inch of backing fabric with a buried loop or tacking tuft on the face of the carpet adequate to fix the rear backstitch yarn in place and avoid free rear yarn on the back of the greige and even further assist in tacking down front yarns.

An optimal number of reciprocations for fixing tacking bights is equal to the number of reciprocations in the shift profile. In FIG. 8, the shift profile is eight steps or reciprocations, and fixing tacking bights every eighth cycle will result in positioning tacked backstitch yarns longitudinally on the backing material. If tacking bights were fixed every four or twelve cycles, the position of the tacked backstitch yarns would be positioned more nearly laterally on the backing material. The more lateral positioning may be useful in two color patterns where the degree of lateral shifting is not particularly significant since the shifting is only by one gauge unit. In a two color pattern with only a two-step shift profile, the more lateral positioning can be accomplished by selecting an odd number of reciprocations between placements of tacking bights. In either case, it is preferred that the alignment of the tacked backstitch yarns between tacking bights be within a 45° angle, and preferably within a 30° angle, and optimally within a 20° angle from the longitudinal direction in which the backing material is fed for tufting.

The yarn feed devices that can be utilized in this configuration are comparable to the yarn feeds that would be used in the case of color selection practiced with a single row of needles. So, for a 12 foot wide tufting machine with a single row of needles sewing at $10^{th}$ gauge, there would be 1200 needles, and 1200 yarn drives would be required to provide for single end yarn control and no pattern repeats across the width of the machine. With the configuration of FIG. 6A, there would be two rows of $1/5^{th}$ gauge needles, and thus 600 needles in each of the front and rear lateral rows of needles. Yarns can be supplied to these needles by a front yarn feed control device with an array of 600 single end yarn drives and a rear yarn feed control device with an array of 600 single end yarn drives—again a total of 1200 yarn drives. Thus an equivalent tufting machine is capable of producing tufted carpet with substantially identical patterns on the face of the carpet and with significantly improved backstitch structure, minimizing loose yarns without significant additional tufting and thereby achieving some yarn savings.

Figure 9:
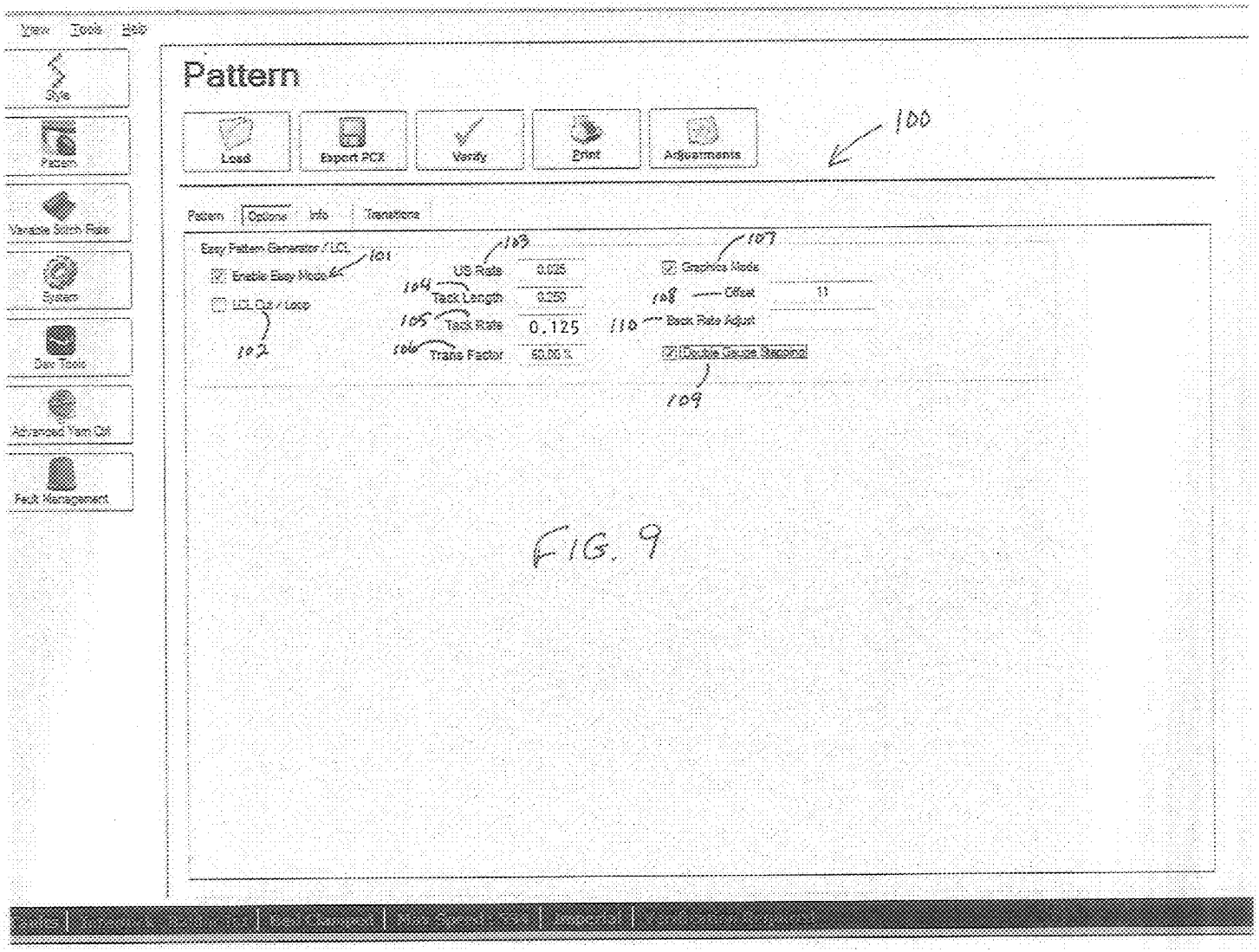
FIG. 9 depicts an exemplary tufting machine control screen for entry of parameters for tacking stitches.

FIG. 9 illustrates an exemplary machine control screen for use with tacking stitches, especially adapted to accommodate two needle bar (graphics) tufting configurations. On screen 100 are mode checked boxes such as LCL Cut Loop or Loop 102 or graphics mode 107 which indicates two shifting needle bars. In connection with graphics mode, it is necessary to specify as "offset" 108 the number of stitches by which the front and rear needle bars are offset for patterning purposes. When the needle bars are spaced one-half inch apart and the tufting machine is tufting 24 stitches per inch, the offset would be 12 stitches. At more typical one-quarter inch spacing in a conventional graphics machine, the offset would be only six stitches. In connection with tufting fabrics where yarns are severely backrobbed, it is also necessary to specify an unsew ("US") feed rate 103 which is the amount of yarn fed on a penetration where the tufted yarn will be entirely removed from the backing and a tack feed rate 105 which is the length of yarn fed to the needles when a yarn tuft is to be backrobbed to a low height, serving as a tacking bight. In the exemplary screen it can be seen that the unsew feed rate is only five hundredths of an inch, which is 60% less than the 0.125 inches of yarn fed for a tacking bight. Some yarns require even greater lengths of yarn for a tacking stitch. This technique of using unsew penetrations in lieu of tacking bights can lead to yarn savings. Even fractions of an inch add up quickly, especially multiplied by hundreds of needles and tens or dozens of needle bars reciprocations per inch of tufted greige.

The control screen also has the operator to set the transition factor 106 which accommodates the lag, largely due to yarn elasticity, when shifting from a low yarn height to a high yarn height. This adjustment is most critically applied to transitions from unsewn tufts to tufts that will remain in the backing. So when proceeding from a no sew yarn feed rate of 0.05 inches to a yarn feed rate that actually displays the yarns on the face of the carpet, of perhaps 0.625 inches, the transition factor calls for the initial high tuft yarn feed to be increased by 60%. In this fashion, the yarn fed to form the first tuft after a no sew stitch instead of being 0.625 inches in length would be about one inch in length [0.625 times 1.6=1.0], to provide sufficient yarn for the first high tuft to reach its full desired height. The usefulness of transition stitches is described in more detail in Morgante, U.S. Pat. No. 6,877,449. By applying a transition factor, it is unnecessary to separately calculate transition values for each possible combination of stitch transitions from unsewn to various tuft heights.

The control system also provides a back rate adjustment 110. This allows the operator to add (or possibly subtract) increments of yarn to the yarns fed to the rear needles. In a staggered graphics set-up, needles on the front and rear needle bars stitch alternating longitudinal columns of stitches. When front and rear needles are sewing different yarns, any difference in height between yarns sewn by front needles and rear needles may appear inconsequential. However, when front and rear needles are sewing the same color yarn in adjacent columns, creating a solid color field, differences in height can be visually unattractive. Such differences are likely to occur because the front needles sew on the backing fabric when it is more firmly supported by needle plate fingers 26. When the rear needles tuft through the backing fabric, that fabric is more likely to yield to downward pressure and thereby reduce the depth of penetration of the yarns through the backing, and several hundredths of an inch of additional yarn fed to a loop may supply an appropriate correction. The back rate adjustment allows yarns fed to rear needles on tuft forming reciprocations to be uniformly incremented in increments of a hundredth of an inch. There is no need to increment yarns fed to tufts that are being unsewn, so the unsewn or "US" yarn feed rate is not adjusted.

The particularly preferred needle configuration of FIG. 6A, most commonly utilized with two offset and staggered 1/5th or 1/6th gauge rows of needles operable by separate shiftable needle bars in a graphics configuration, has been utilized to tuft patterns of the novel types as demonstrated in FIG. 10. In FIG. 10, two colors of rear yarns 85, 86 are threaded on the rear needles 15 and the same two colors of front yarns 95, 96 are threaded on the front needles 14. Twelve repeats of yarns 85,86 and 95,96 are illustrated, designated as $\mathbf{85}_1,\mathbf{86}_1$ through $\mathbf{85}_{12}$, $\mathbf{86}_{12}$ and $\mathbf{95}_1,\mathbf{96}_1$ through $\mathbf{95}_{12},\mathbf{96}_{12}$ respectively. Penetrations of the backing for each yarn on sequential needlebar strokes are designated by sequentially increasing letters a, b, c, through bbbb for the eighty illustrated stitches. The first stitch shows first front yarns 95 being tufted at 95*a* and first rear yarns 85 being tufted at 85*g*, with a seven stich offset as the backing is fed in the direction of the arrow. This is commonly referred to as an A,B/A,B thread-up. With three or four different yarns, the needle bars could be threaded as A,B, C/A,B,C or A,B,C,D/A,B,C,D. While the most optimal thread-ups appear to involve between two and four colors of yarn, even five or six colors can be used in A,B,C,D,E/A, B,C,D,E or A,B,C,D,E,F/A,B,C,D,E,F thread-ups.

The stitch offset for one-quarter inch can be readily calculated according to the following table, to allow for adjustment of the stitch rate to produce a carpet of appropriate density

| Longitudinal Stitches per Inch | Offset |
|---|---|
| 8, 9, 10, 11 | 3 |
| 12, 13, 14, 15 | 4 |
| 16, 17, 18, 19 | 5 |
| 20, 21, 22, 23 | 6 |
| 24, 25, 26, 27 | 7 |
| 28, 29, 30, 31 | 8 |
| 32, 33, 34, 35 | 9 |
| 36, 37, 38, 39 | 10 |
| 40, 41, 42, 43 | 11 |
| 44, 45, 46, 47 | 12 |
| 48, 49, 50, 51 | 13 |

Figure 10A:
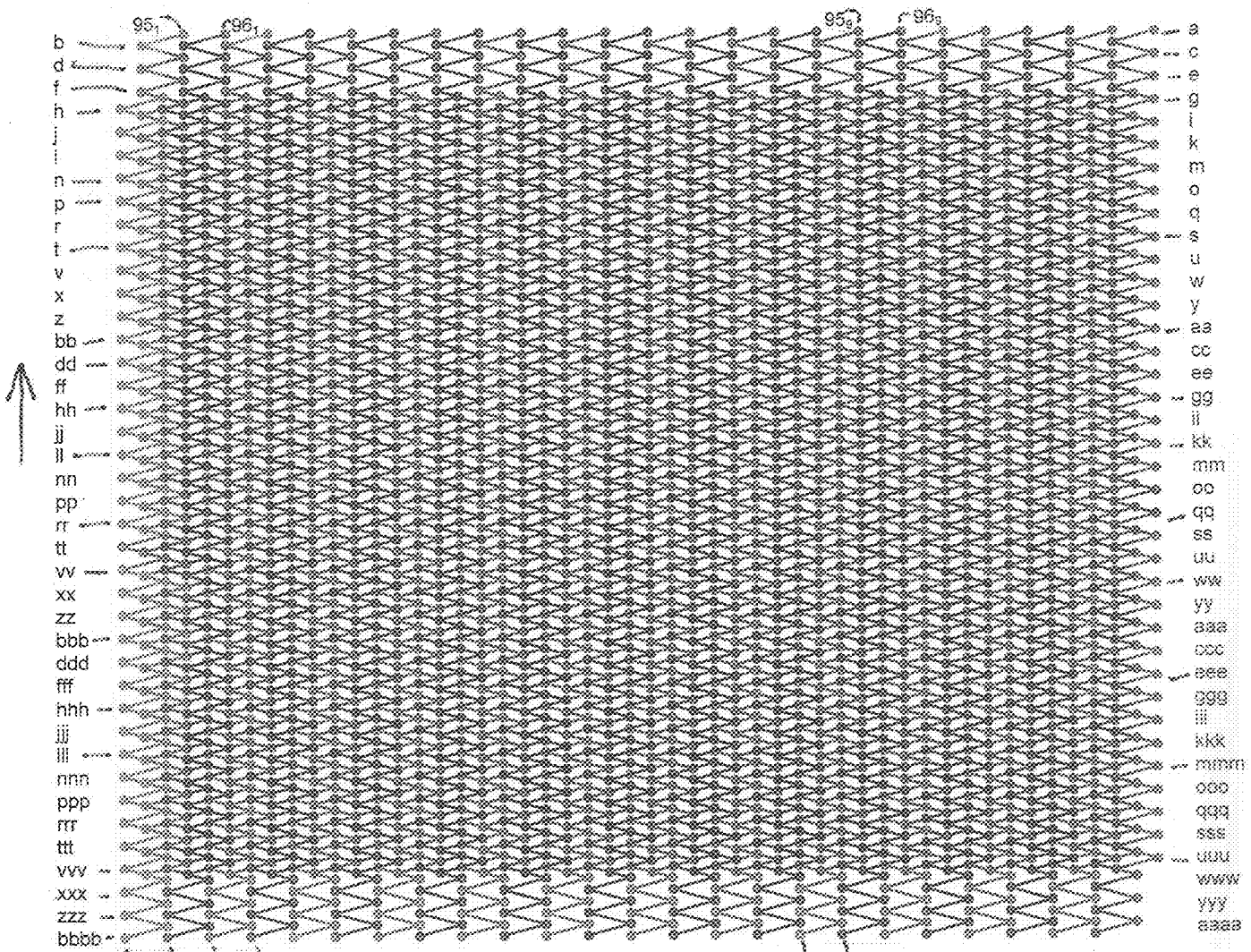
FIG. 10A depicts the backstitching of two offset needle bars that are staggered from one another with A, B yard thread ups, with full gauge shifting.

In FIG. 10A, tufts are being formed at each penetration of the carpet so that the potential tuft locations are more readily understood. Thus after the offset has been tufted, rear yarns 85, 86 are interspersed between front yarns 95, 96 and the spacing between tufts of first yarns 85 and 95 of the same color is relatively uniform over the field of stitching as is the spacing of penetration points of second yarns 86, 96. For reference, each such penetration is designated by yarn number and stitch number, thus the first penetration by the first of the first front yarns is ($\mathbf{95}_1$,a). The illustration of FIG. 10B showing the face of the fabric with a small phantom circle for each of these penetrations tufted as a small tuft or tacking bight and larger solid circle if tufted as a visible yarn bight reflects this relatively uniform dispersal.

Figure 10B:
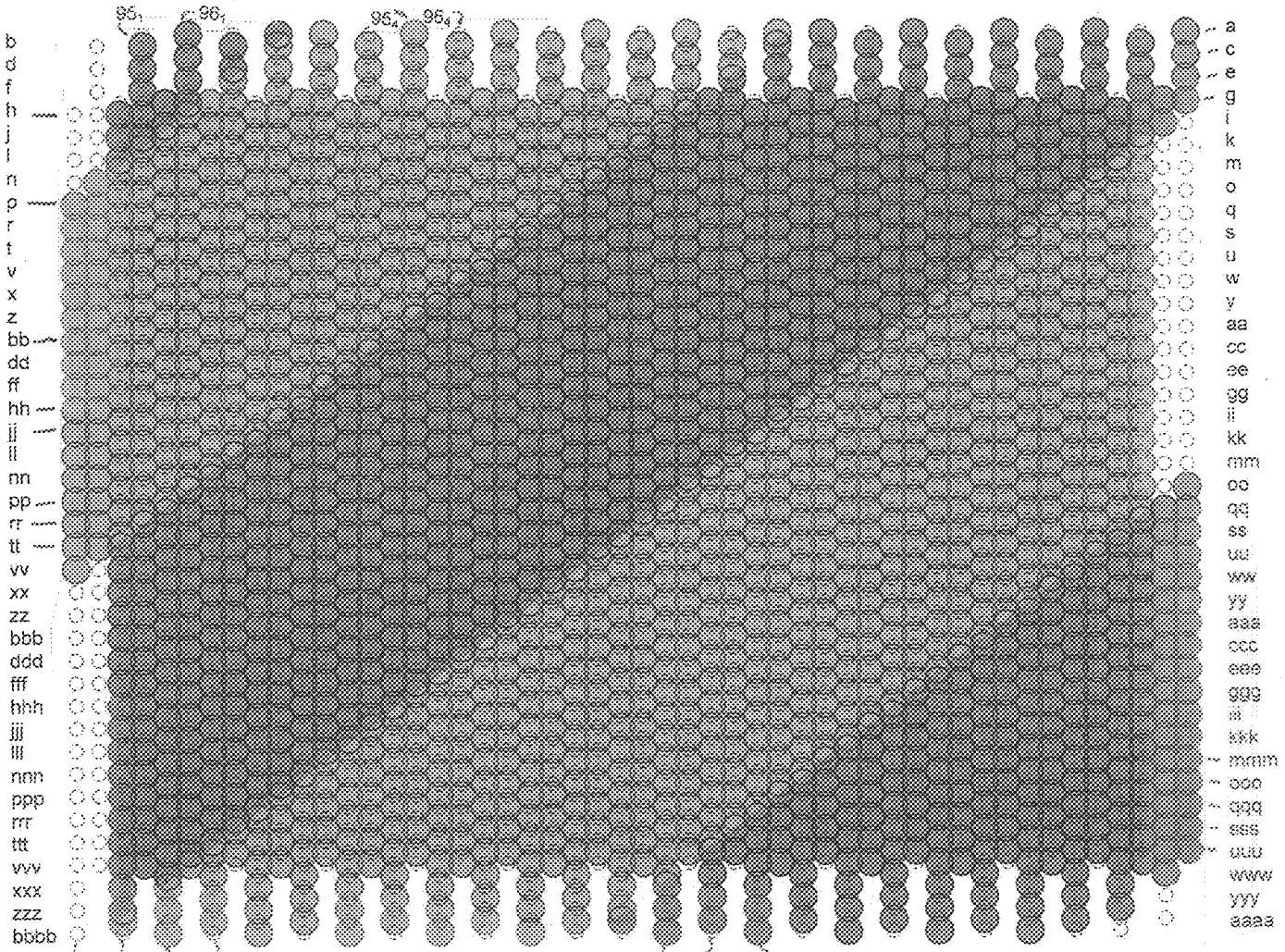
FIG. 10B is the face of an exemplary fabric tufted with the backstitching of FIG. 10A with low tufts shown in phantom.
Figure 10C:
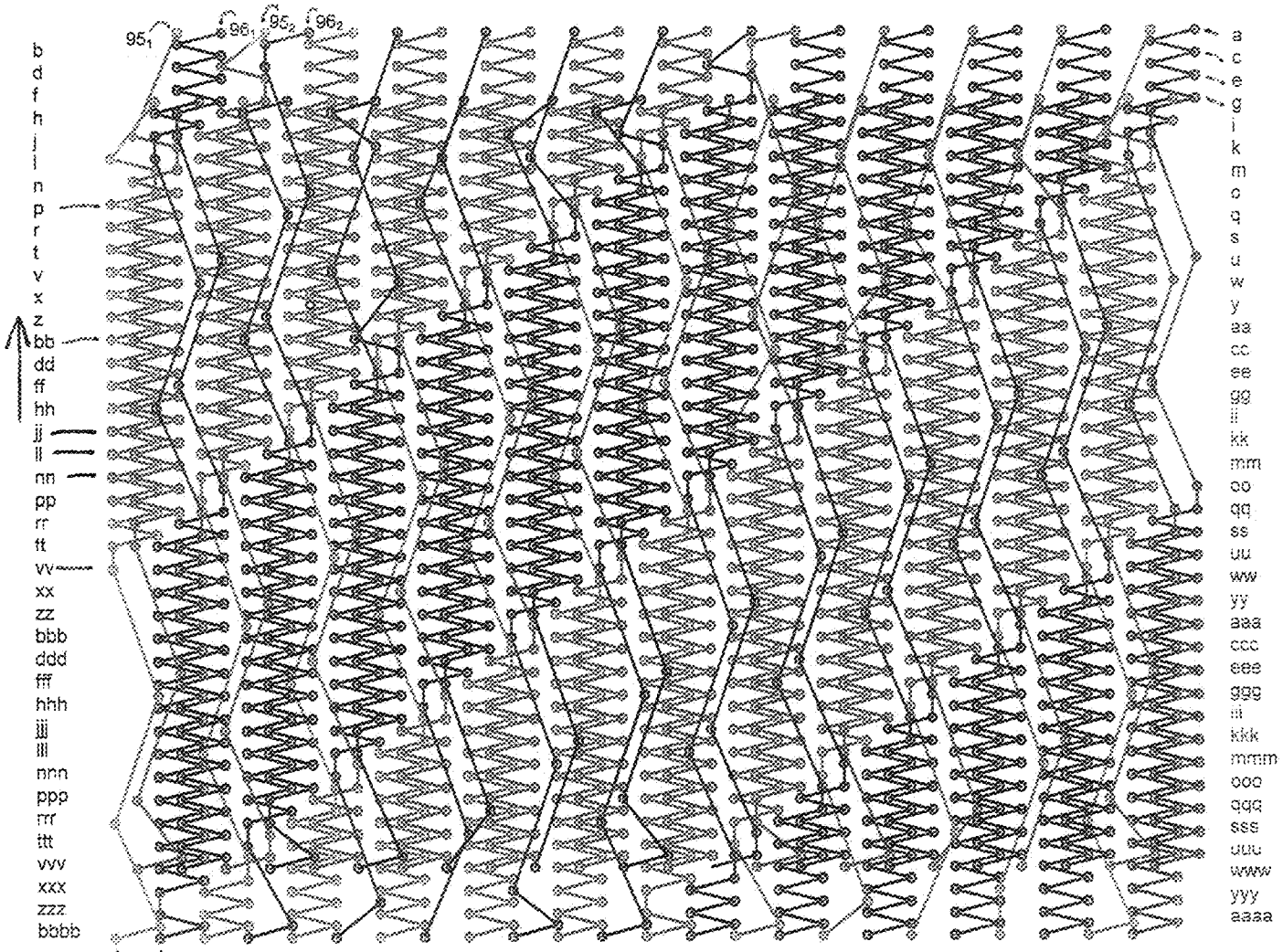
FIG. 10C depicts the backstitching of two offset needle bars as in FIG. 10A with A, B thread ups, utilizing intermittent tacking.

In the illustrated diagonal stripe pattern of FIG. 10B, it can be seen that front yarn $\mathbf{95}_1$ is tufted low at penetration ($\mathbf{95}_1$,a) through penetration ($\mathbf{95}_1$,j). Then penetration ($\mathbf{95}_1$,k) is tufted high and penetration ($\mathbf{95}_1$,l) is tufted low and penetration s ($\mathbf{95}_1$,m) through ($\mathbf{95}_1$,rr) are tufted high, penetration ($\mathbf{95}_1$,ss) is tufted low, penetration ($\mathbf{95}_1$,tt) is tufted high and penetration s from ($\mathbf{95}_1$,uu) onward are tufted low.

However, two significant modifications are preferably made to the appearance of the backstitch in FIG. 10A and face of FIG. 10B when actual patterns are tufted. First, many of the tufts of yarns are pulled low, and many may be totally removed from backing fabric, while other tufts of yarn are tufted to a relatively higher height to conceal the adjacent area of the backing. Secondly, for the yarn tufts that are backrobbed so that they are totally removed from the backing fabric, the yarns are typically fed to periodically form low tufts to tack the backstitching. Yet, in-between these tacking bights, the yarns may proceed in a direct line across the backing fabric rather than in the zigzag pattern as they are positioned by operation of the shifting and reciprocating needle bars as reflected in FIG. 10A. The shorter lengths of yarn required for these removed or unsewn tufts and the direct transition between tacking bights save significant quantities of yarn often in the range of 2% to 10% of total yarn consumption for a particular pattern.

Figure 10D:
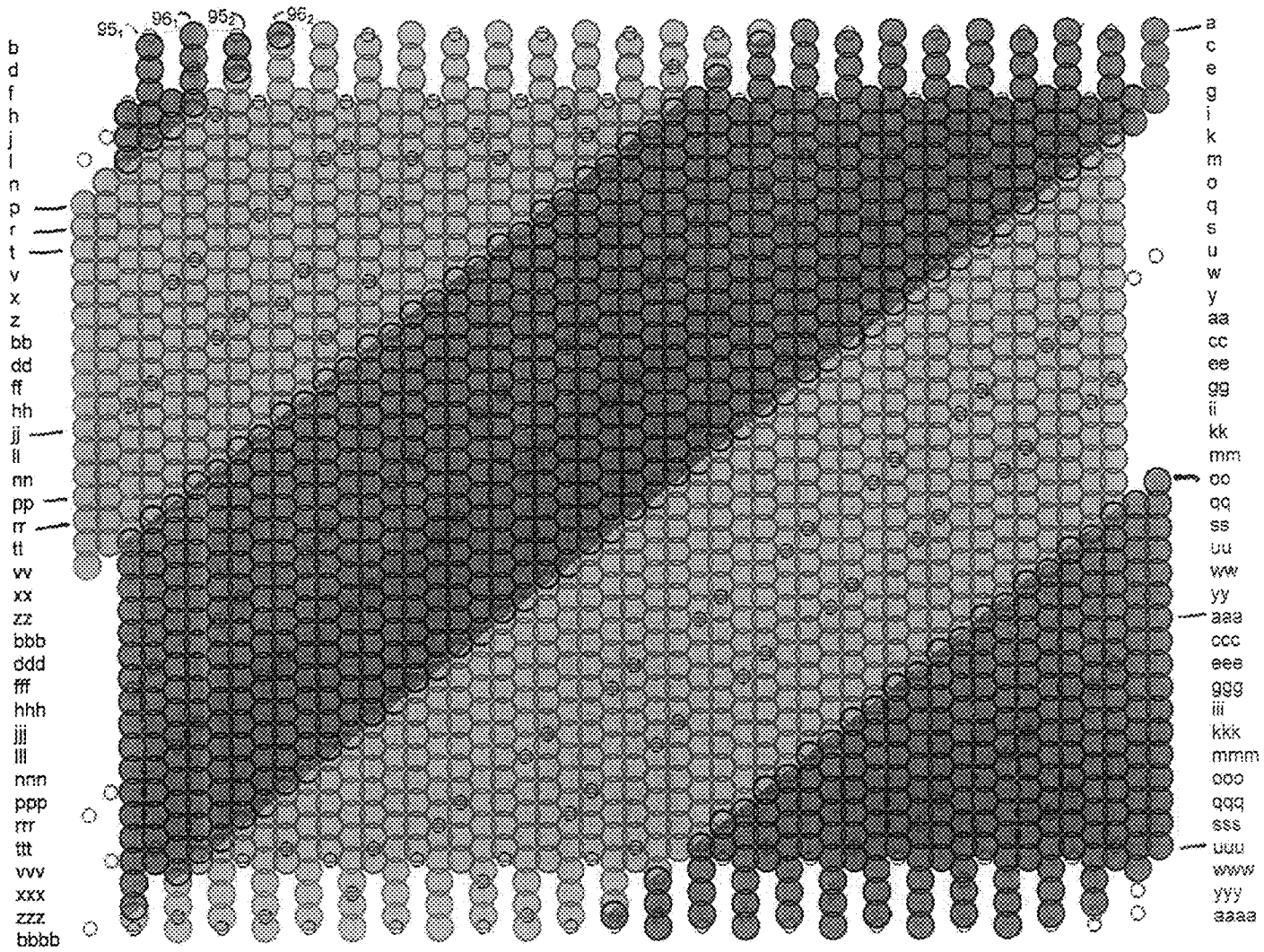
FIG. 10D depicts the face of the fabric tufted in FIG. 10C, with tacking tufts concealed beneath the face yarns shown in phantom.

Accordingly, 10C depicts the backing fabric of the A,B yarn thread-up illustrated in FIG. 10A with tacking bights provided by the needles every 0.5 inches. FIG. 10D depicts the face of the carpet with the horizontal pattern created by the backstitching of FIG. 10C and the substantially reduced number of phantom circles representing tacking bights is apparent.

So again following yarn $\mathbf{95}_1$, the yarn is first tufted as a tacking bight at ($\mathbf{95}_1$,a), is tacked low again at ($\mathbf{95}_1$,j), is tufted high at ($\mathbf{95}_1$,k) and ($\mathbf{95}_1$,m) through ($\mathbf{95}_1$,rr). Then the yarn is again tufted high at ($\mathbf{95}_1$,tt), is tacked at ($\mathbf{95}_1$,eee) and ($\mathbf{95}_1$,ppp) as well as ($\mathbf{95}_1$,uuu) and ($\mathbf{95}_1$,vvv) where the eighty stroke illustration ends. For the purposes of longitudinally aligning backstitch yarns, it can be seen that the backstitch yarn between tacking bights at ($\mathbf{95}_1$,a) and ($\mathbf{95}_1$,j) is aligned within about 20° of the longitudinal direction of the backing material feed represented by the upward arrow in the direction from j to b.

It is also instructive to point out where yarns $\mathbf{95}_2$ and $\mathbf{96}_2$ are tufted high and as tacking bights. First yarn $\mathbf{95}_2$ is tacked at ($\mathbf{95}_2$,a), is tufted high at ($\mathbf{95}_2$,b), ($\mathbf{95}_2$,d) through ($\mathbf{95}_2$,ll) and at ($\mathbf{95}_2$,nn), than has tacking bights at ($\mathbf{95}_2$,yy), ($\mathbf{95}_2$,jjj) and high tufts at ($\mathbf{95}_2$,sss), ($\mathbf{95}_2$,uuu) and ($\mathbf{95}_2$,vvv).

Figure 10E:
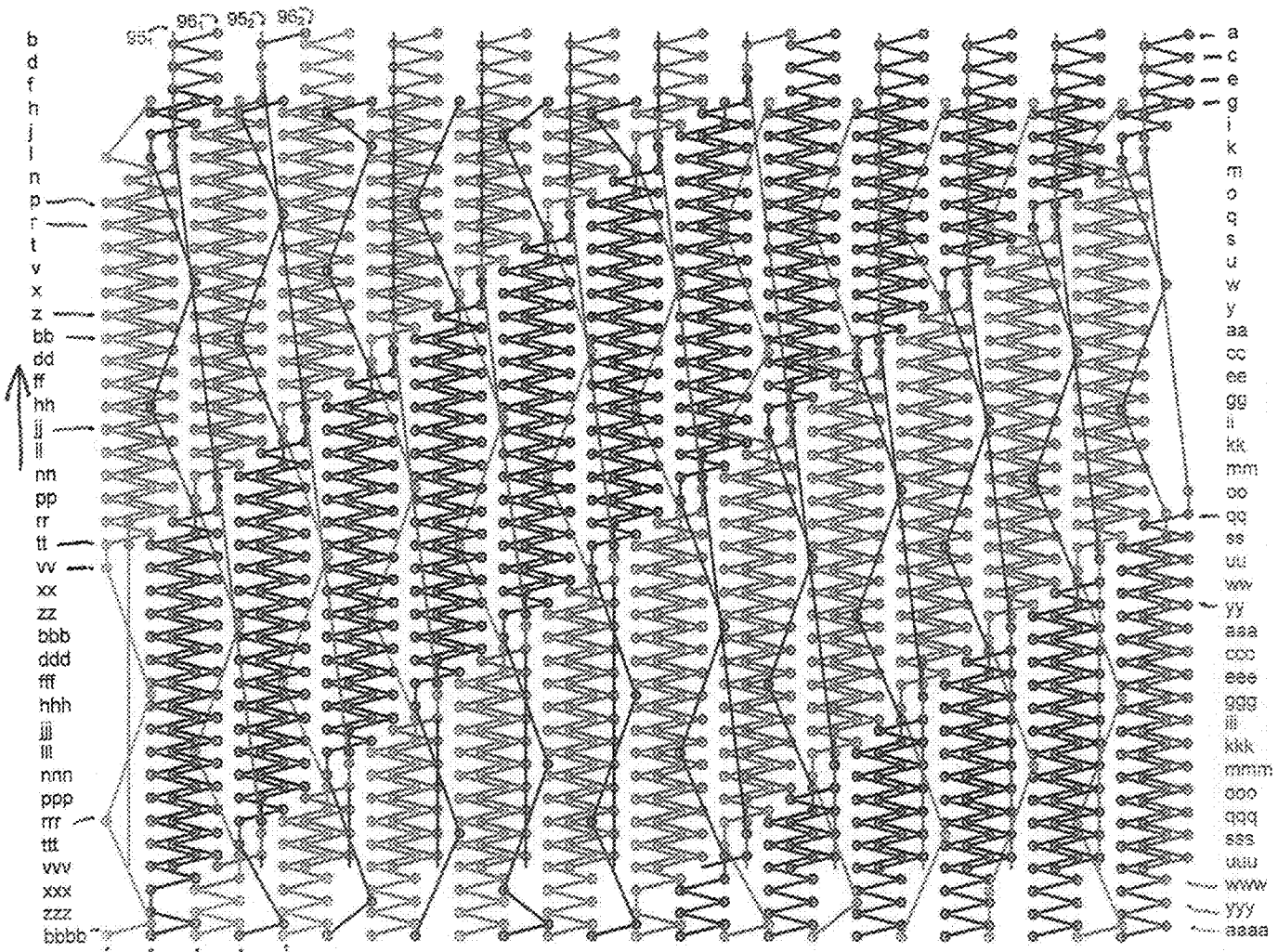
FIG. 10E illustrates the backstitching of two offset needle bars as in FIG. 10A with A, B thread ups, utilizing intermittent tacking on the rear needle bar and with no tacking stitches on the front needle bar.

Then turning to FIG. 10E, the front yarns are not designated for any tacking bights, instead relying upon the overtufting by rear yarns to tack the front yarns in place. So once more examining first front yarns $\mathbf{95}_1$ and $\mathbf{95}_2$, these yarns have no tacking bights. The first tuft by yarn $\mathbf{95}_1$ is at ($\mathbf{95}_1$,k). However, rear yarn $\mathbf{86}_1$ has overtufted front yarn $\mathbf{95}_1$ three times between needle strokes a and k. The yarn extending between tufts ($\mathbf{86}_1$, g) and ($\mathbf{86}_1$,h); between tufts ($\mathbf{86}_1$,h) and ($\mathbf{86}_1$,i); and between tufts ($\mathbf{86}_1$,i) and ($\mathbf{86}_1$,j) crosses over and holds yarn $\mathbf{95}_1$ to the greige back.

Then in connection with first front yarn $\mathbf{95}_2$, it generally tufts high from about ($\mathbf{95}_2$,e) to ($\mathbf{95}_2$,nn), but does not tuft high again until ($\mathbf{95}_2$,sss). However, at needle stroke aaa, rear yarn $\mathbf{85}_2$ over tufts yarn $\mathbf{95}_2$ with a tacking bight. Furthermore, from needle stroke fff, yarn $\mathbf{86}_2$ is overtufting yarn $\mathbf{95}_2$ on alternate strokes until ($\mathbf{95}_2$,sss). So overtufting by rear yarns is generally adequate to tack the front yarns.

Figure 10F:
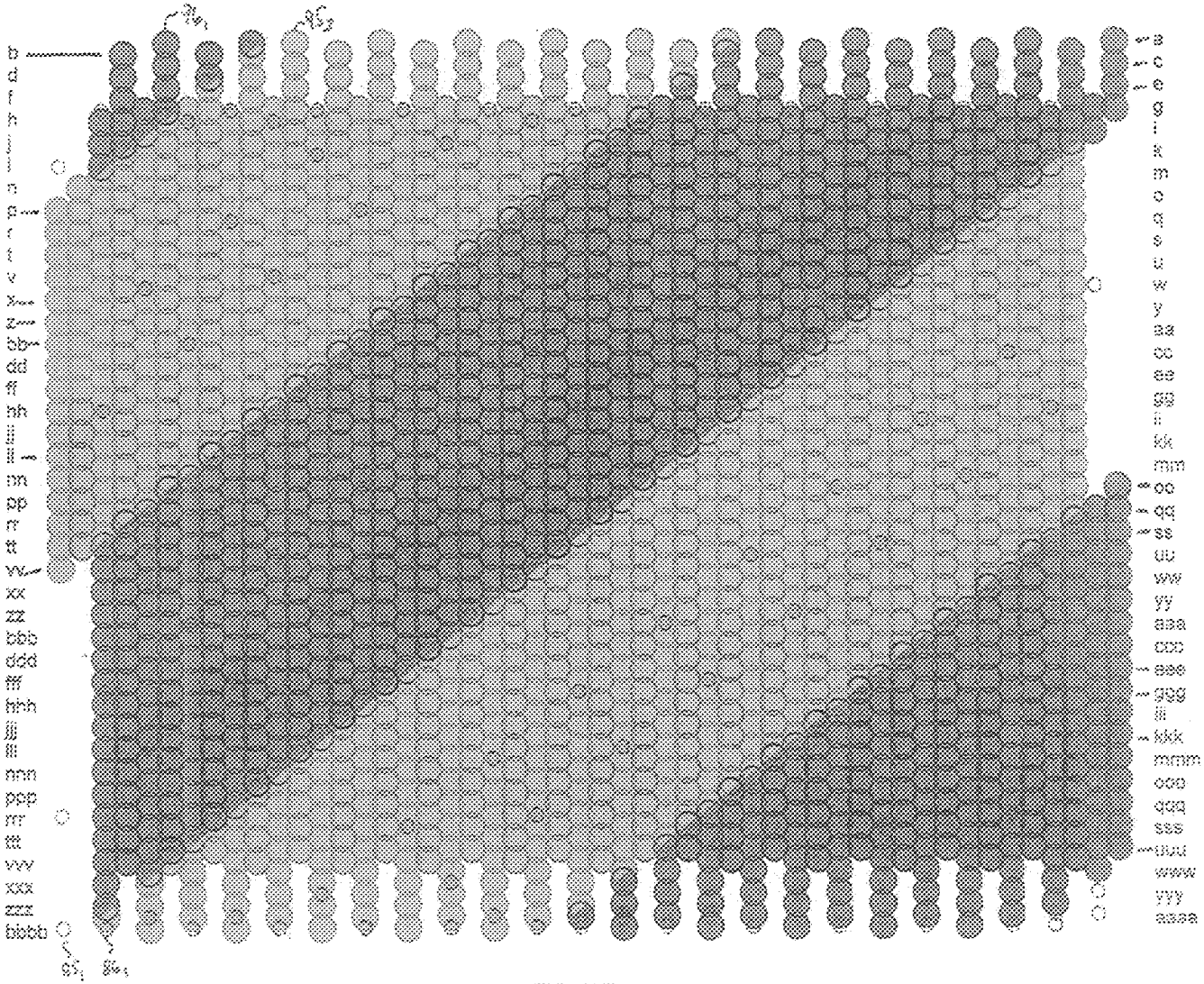
FIG. 10F depicts the face of the fabric tufted in FIG. 10E with tacking tufts concealed beneath the face yarns shown in phantom.

FIG. 10F illustrates the rear yarn only tacking of FIG. 10E and it is readily apparent that only about half as many tacking bights are present relative to FIG. 10D.

As discussed above, tacking is only necessary in a graphics machine with the rear needle bar which is over tufting the back stitching from the front needle bar, however some provision must be made to ensure that a tacking bight is entered periodically by rear needles. Accordingly, the tack length is specified, in this instance at 0.5 inches which would be every 12 reciprocations of the needle bar. However, tacking could be specified as frequently as alternative strokes or as infrequently as about 1.0 inches. Often it is desirable to select a tacking distance that corresponds to the number of strokes in a shift profile so that tacked yarns will proceed directly in a longitudinal direction along the griege.

Figure 11A:
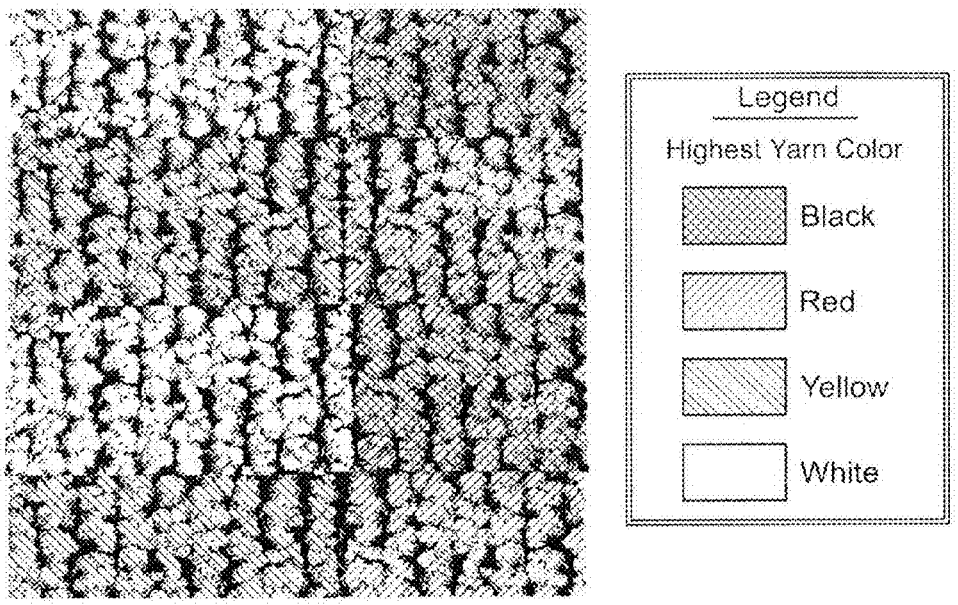
FIG. 11A depicts a fabric tufted on a graphics machine with two ⅕th gauge needle bars having a front A, B and rear C, D thread-up.

FIG. 11A depicts a fabric tufted on a graphics machine with two ⅕th gauge needle bars having a front A, B and rear C, D thread-up. This is the customary thread-up for four yarn colors on a two needle bar (graphics) machine. However, it can be readily seen that in solid areas this results in a ⅕th gauge fabric. The columns of yarn tufted in a solid area all come from the same ⅕th gauge needle bar and at a low or medium height, many yarns may not provide complete coverage of the backing or of the hidden low stitches between the columns of displayed stitches. This form of A,B/C,D thread-up, or a two yarn A/B thread-up, have been the conventional methods of configuring graphics machines for tufting. Such thread-up were favored because it placed each color yarn closest to the lateral position where it might need to be displayed. Many such configurations were also designed for use without high/low patterning capability, or at least without scroll or single end high/low patterning. Some configurations also contemplated shifting only one needle bar.

Figure 11B:
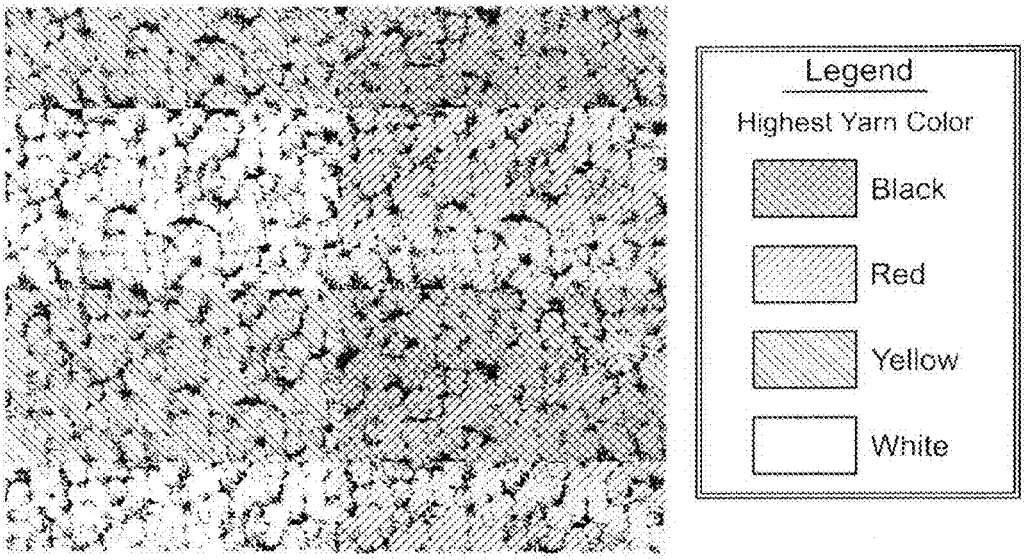
FIG. 11B depicts a fabric tufted on a graphics machine with two ⅕th gauge needle bars each having an A,B,C, D thread-up.

FIG. 11B depicts a fabric tufted on a graphics machine with two ⅕th gauge needle bars each having an A,B,C, D thread-up. In this fashion, yarns of a single color can be provided from each needle bar, thus stitching at the composite 1/10th gauge of the two staggered $1/5^{th}$ gauge needle bars. This results in tenth gauge coverage of the backing material, however because a tuft from each needle bar is required, there is only double tuft or double tenth gauge pixel pattern resolution. This lack of resolution is not apparent in horizontal and vertical lined patterns, but in patterns with diagonal lines such as that of FIG. 10 it is more noticeable. Even so, double stitch or ⅕th gauge resolution is suitable for many carpet designs. Using two ⅙ th gauge needle bars can produce twelfth gauge coverage of the backing material.

The use of A,B/A,B; A,B,C/A,B,C; or A,B,C,D/A,B,C,D thread-ups with the same repeating sequence of yarns on the front and rear needle bars provides the capability for composite gauge resolution of a single yarn, though with double tuft resolution. When only A yarns are tufted from each needle bar in a region of a pattern and all other yarns are backrobbed from the backing material except for some low tufts or tacking bights, the A yarns present the lateral density of the composite gauge. By adjusting the reciprocation rate, or longitudinal rate of stitches per inch, any reasonable longitudinal density of tufts can also be obtained.

All publications, patent, and patent documents mentioned herein are incorporated by reference herein as though individually incorporated by reference. Numerous alterations of the structure herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included within the scope of the appended claims.

We claim:

1. In a tufting machine of the type having front and rear rows of spaced needles disposed transversely across the width of the machine, said front and rear rows of needles being laterally spaced at the same needle gauge, and said front and rear rows being longitudinally spaced apart by an offset, a pattern yarn feed attachment for supplying yarns to the needles, a needle bar shifter for shifting the transverse rows of needles, front loopers spaced apart at the needle gauge operable to seize yarns from the front needles and rear loopers spaced apart at the needle gauge operable to seize yarns from the rear needles, said front and rear loopers being staggered relative to one another, a control system for providing pattern information to the pattern yarn feed attachment and needle bar shifter a method of forming a tufted fabric comprising threading the front transverse row of needles with a repeating sequence of at least first yarns and second yarns;

threading the rear transverse row of needles with the same repeating sequence of at least first yarns and second yarns;

feeding a backing fabric with a first face surface and an opposite back surface through the tufting machine and reciprocating the front and rear transverse rows of needles to cause the plurality of yarns to penetrate the face surface of the backing fabric;

seizing the yarns penetrating the face surface of the backing fabric with loopers;

laterally shifting the front and rear transverse rows of needles;

controlling the feeding of yarns to the transverse rows of needles in accordance with the pattern information and in accordance with a pattern offset to form areas of relatively adjacent high tufts of first yarns from the front row of needles and high tufts of first yarns from the rear row needles to be displayed and second yarns from the front and rear rows of needles to be hidden.

2. The method of claim 1 wherein the gauge of the front transverse row of needles is selected from the group of ¼th gauge, ⅕th gauge, ⅙th gauge, 1/7th gauge and 5/32nds gauge.

3. The method of claim 1 wherein the needles are laterally shifted according to a shift profile having shift steps equal to the gauge of the front transverse row of needles.

4. The method of claim 1 wherein for each reciprocation of the needles the backing fabric is advanced on average by a distance in inches equal to between one and two times the reciprocal of a quantity determined by multiplying the number of yarns in the repeating sequence by the number of needles per inch in the composite gauge of the two rows of needles.

5. The method of claim 4 wherein between one and two times is between 1.25 and 1.67 times.

6. The method of claim 1 wherein the yarn feed control supplies yarn to form a single relatively high tuft from substantially each repeating sequence of at least first yarns and second yarns over each sequence of reciprocations of rows of needles, said sequence having a number of reciprocations equal to the number of yarns in the repeating sequence.

7. The method of claim 1 wherein the yarns on the back surface are backstitch yarns and the backstitch yarns of the rear needles overtuft the backstitch yarns of the front needles.

8. The method of claim 7 wherein with respect to yarns fed to the front row of needles to form relatively low hidden tufts, the yarns are backrobbed so that a majority of such low hidden tufts are withdrawn from the face of the backing fabric.

9. The method of claim 7 wherein segments of backstitch yarns are fixed to the backing fabric with tacking bights.

10. The method of claim 9 wherein the maximum distance between tacking bights for a segment of backstitch yarn is about one half inch.

11. The method of claim 9 wherein the distance between tacking bights for a segment of backstitch yarn is between two and fourteen reciprocations of the needles.

12. The method of claim 9 wherein the rows of needles are shifted according to a shift profile and distance between tacking bights for a segment of backstitch yarn is a multiple of a number of steps in the shifting profile.

13. The method of claim 1 wherein the backing fabric is a nonwoven fabric.

14. The method of claim 1 wherein the threaded repeating sequence includes at least first yarns, second yarns, and third yarns.

15. The method of claim 14 wherein the threaded repeating sequence includes fourth yarns.

16. A method of tufting a patterned fabric from a plurality of colored yarns on a tufting machine comprising the steps of:

a) providing a tufting machine with pattern information;

b) threading a first plurality of yarns through a yarn feed pattern control device to a front row of needles, said needles of the front row being transversely spaced apart from one another by a gauge distance and the first plurality of yarns being distributed to the needles in a repeating color sequence;

c) threading a second plurality of yarns through a yarn feed pattern control device to a rear row of needles, said needles of the rear row being transversely spaced apart from one another by the gauge distance and the second plurality of yarns being distributed to the needles in the repeating color sequence;

d) feeding a backing fabric longitudinally through the tufting machine from front to back;

e) reciprocating the front and rear rows of needles to penetrate the backing fabric to thereby carrying loops of the first and second pluralities of yarns from a back side of the backing fabric to a face side of the backing fabric;

f) operating front loopers on the face side of the backing fabric to seize loops of the first plurality of yarns and operating rear loopers, staggered from the front loopers, on the face side of the backing fabric to seize loops of the second plurality of yarns; and g) operating the yarn feed pattern control device in accordance with the pattern information and a pattern offset to form relatively high loops and relatively low loops from the first and second pluralities of yarns such that the relatively high loops are displayed and relatively low loops are at least partially concealed.

17. The method of claim 16 wherein the needles are shifted by the gauge distance between penetrations of the backing fabric by the needles.

18. The method of claim 16 wherein the yarns from the first plurality fed to the front row of needles to form relatively low hidden tufts are backrobbed so that a majority of such low hidden tufts are withdrawn from the face of the backing fabric leaving backstitching on the back side and yarns from the second plurality fed to the rear row of needles overtuft the backstitching of the first plurality on the back side of the backing fabric.

19. The method of claim 16 wherein for each reciprocation of the rows of needles the backing fabric is advanced by a distance in inches that is approximately the reciprocal of the quantity determined by multiplying the number of colors of yarn in the repeating color sequence multiplied by the number of needles per inch in the composite gauge of the two rows of needles.

20. The method of claim 16 wherein the first plurality of yarns comprises two colors of yarn threaded in alternating fashion on the front row of needles to form the repeating color sequence in the first plurality of yarns and the same two colors of yarn threaded in alternating fashion on the rear row of needles to form the second plurality.

21. The method of claim 9 wherein most segments of backstitch yarns that are fixed between tacking bights are oriented within 30° of the longitudinal direction of the direction of the backing feed.

* * * * *